US009080122B2

(12) United States Patent
Kwon et al.

(10) Patent No.: US 9,080,122 B2
(45) Date of Patent: Jul. 14, 2015

(54) NANOPARTICLE GRAPHITE-BASED MINIMUM QUANTITY LUBRICATION METHOD AND COMPOSITION

(75) Inventors: Patrick Kwon, Okemos, MI (US); Lawrence T. Drzal, Okemos, MI (US)

(73) Assignee: BOARD OF TRUSTEES OF MICHIGAN STATE UNIVERSITY, East Lansing, MI (US)

( * ) Notice: Subject to any disclaimer, the term of this patent is extended or adjusted under 35 U.S.C. 154(b) by 534 days.

(21) Appl. No.: 12/655,649

(22) Filed: Jan. 5, 2010

(65) Prior Publication Data

US 2010/0204072 A1 Aug. 12, 2010

Related U.S. Application Data

(60) Provisional application No. 61/204,366, filed on Jan. 6, 2009.

(51) Int. Cl.
*C10M 125/02* (2006.01)

(52) U.S. Cl.
CPC ..... *C10M 125/02* (2013.01); *C10M 2201/041* (2013.01); *C10M 2207/401* (2013.01); *C10N 2220/08* (2013.01); *C10N 2220/082* (2013.01); *C10N 2230/06* (2013.01); *C10N 2230/40* (2013.01); *C10N 2240/401* (2013.01); *C10N 2240/402* (2013.01); *C10N 2250/12* (2013.01); *C10N 2270/00* (2013.01)

(58) Field of Classification Search
USPC ..... 508/113
See application file for complete search history.

(56) References Cited

U.S. PATENT DOCUMENTS

| | | | | |
|---|---|---|---|---|
| 5,516,213 | A * | 5/1996 | Moriyama et al. | 384/292 |
| 5,780,396 | A * | 7/1998 | Tanaka et al. | 508/104 |
| 8,110,026 | B2 * | 2/2012 | Prud'Homme et al. | 96/4 |
| 2004/0127621 | A1 | 7/2004 | Drzal et al. | |

(Continued)

FOREIGN PATENT DOCUMENTS

WO WO 2008143692 A1 * 11/2008

OTHER PUBLICATIONS

Ueda et al., Effect of Oil Mist on Tool Temperature in Cutting, Feb. 2006, ASME, vol. 128, 130-135.*

(Continued)

*Primary Examiner* — Taiwo Oladapo
(74) *Attorney, Agent, or Firm* — Marshall, Gerstein & Borun LLP

(57) ABSTRACT

A lubricant composition is disclosed that includes (a) a machining oil and (b) an exfoliated graphite nanoparticle (EGN) material stably dispersed in the machining oil. The lubricant composition is a stable suspension and is suitable for use as a liquid lubricant in a Minimum Quantity Lubrication (MQL) process. In the MQL process, the lubricant composition is applied/transferred to a worksite in the form of a mist. The presence of the EGN material in the lubricant composition provides high-temperature stability and lubricity under MQL conditions. A very small amount is transferred especially at high cutting speeds where the mist of the machining oil evaporates, but the EGN material remains on the surface to provide lubricity. Any operation involving machining can benefit from this lubricant composition. The method provides important benefits of reducing chipping on cutting tools and providing the additional lubricity especially when the cutting become very hot and thus extending tool life.

21 Claims, 18 Drawing Sheets

(56) References Cited

U.S. PATENT DOCUMENTS

| | | | | |
|---|---|---|---|---|
| 2004/0258493 | A1* | 12/2004 | Sugano et al. | 408/222 |
| 2006/0148965 | A1 | 7/2006 | Drzal et al. | |
| 2006/0231792 | A1 | 10/2006 | Drzal et al. | |
| 2006/0241237 | A1 | 10/2006 | Drzal et al. | |
| 2007/0092432 | A1* | 4/2007 | Prud'Homme et al. | 423/448 |
| 2007/0191240 | A1* | 8/2007 | Suda | 508/485 |
| 2008/0026967 | A1 | 1/2008 | Suda et al. | |
| 2010/0140792 | A1* | 6/2010 | Haddon et al. | 257/713 |

OTHER PUBLICATIONS

Alberts et al., An Investigation of graphite nanoplatelets as lubricant in grinding, Jun. 21, 2009, International Journal of Machine Tools & Manufacture, vol. 49, 966-970.*

Alberts, M., Kalaitzidou, K., and Malkote, S. (2009) "An investigation of graphite nanoplatelets as lubricant in grinding", International Journal of Machine Tools and Manufacutre, 49, pp. 966-970.

Askvik, K. M., S. Hoiland, P. Fotland, T. Barth, T. Gronn and F. H. Fadnes (2005). "Calculation of wetting angles in crude oil/water/quartz systems," Journal of Colloid and Interface Science, vol. 287, pp. 657-663.

Heinemann, R., S. Hinduja, G. Barrow and G. Petuelli, (2006). "Effect of MQL on the tool life of small twist drills in deep-hole drilling," International Journal of Machine Tools & Manufacturing, vol. 46, pp. 1-6.

Itoigawa, F., T.H.C. Childs, T. Nakamura and W. Belluco (2006). "Effects and Mechanisms in Minimal Quantity Lubrication Machining of Aluminum Alloys," Wear, vol. 29, N. 3, pp. 339-344.

Klocke, F. and G. Eisenblatter, (1997). "Dry Cutting," CIRP Annals-Manufacturing Technology, vol. 46, No. 2, pp. 510-526.

Krishna, P., Rao, D., and Srikant, R., (2009) "Predictive modelling of surface roughness and tool wear in solid lubricant assisted turning of AISI 1040 Steel" Journal of Engineering Tribology, vol. 223, pp. 929-934.

Lopez de Lacalle, L. N., C. Angulo, A. Lamikiz and J. A. Sanchez (2006). "Experimental and numerical investigation of the effect of spray cutting fluids in high speed milling," Journal of Material Processing Technology, vol. 172, pp. 11-15.

Rao, D., and Krishna, P. (2008) "The influence of solid lubricant particle size on machining parameters in turning", International Journal of Machine Tools and Manufacture, 48, pp. 107-111.

Shen, B., A.P. Malshe, P. Kalita and A.J. Shih (2008). "Performance of Novel MoS2 Nanoparticles Based Grinding Fluids in Minimum Quantity Lubrication Grinding," Transaction of NAMRI/SME, V. 36, pp. 357-364.

Sokovic, M., J. Kopac, L.A. Dobrzanski and M. Adamiak (2004). "Wear of PVD-coated solid carbide end mills in dry high-speed cutting," Journal of Materials Processing Technology, vol. 157-158, pp. 422-426.

Sreejith, P.S. and B.A. Ngoi (2000). "Dry machining: Machining of the future," Journal of Materials Processing Technology, vol. 101, No. 1-3, pp. 287-291.

Ueda, T., A. Hosokawa and K. Yamada, "Effect of oil mist on tool temperature in cutting," Journal of Manufacturing Science and Engineering, vol. 128, pp. 130-135, 2006.

Wakabayashi, T., I. Inasaki and S. Suda (2006) "Tribological action and optimal performance: Research activities regarding MQL machining fluids," Machining Science and Technology, vol. 10, pp. 59-85.

* cited by examiner

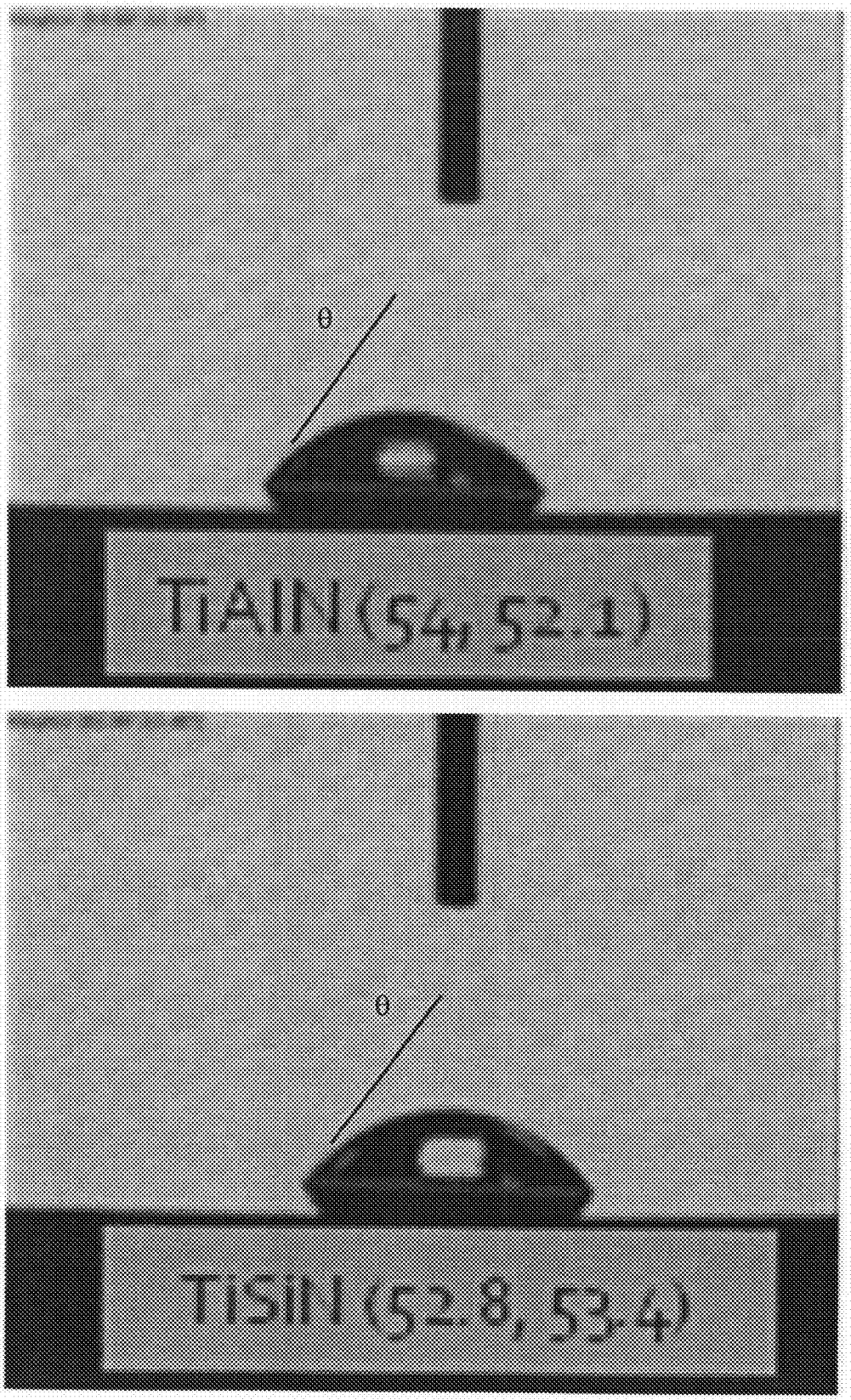
Figure 8 (a) – Water droplets

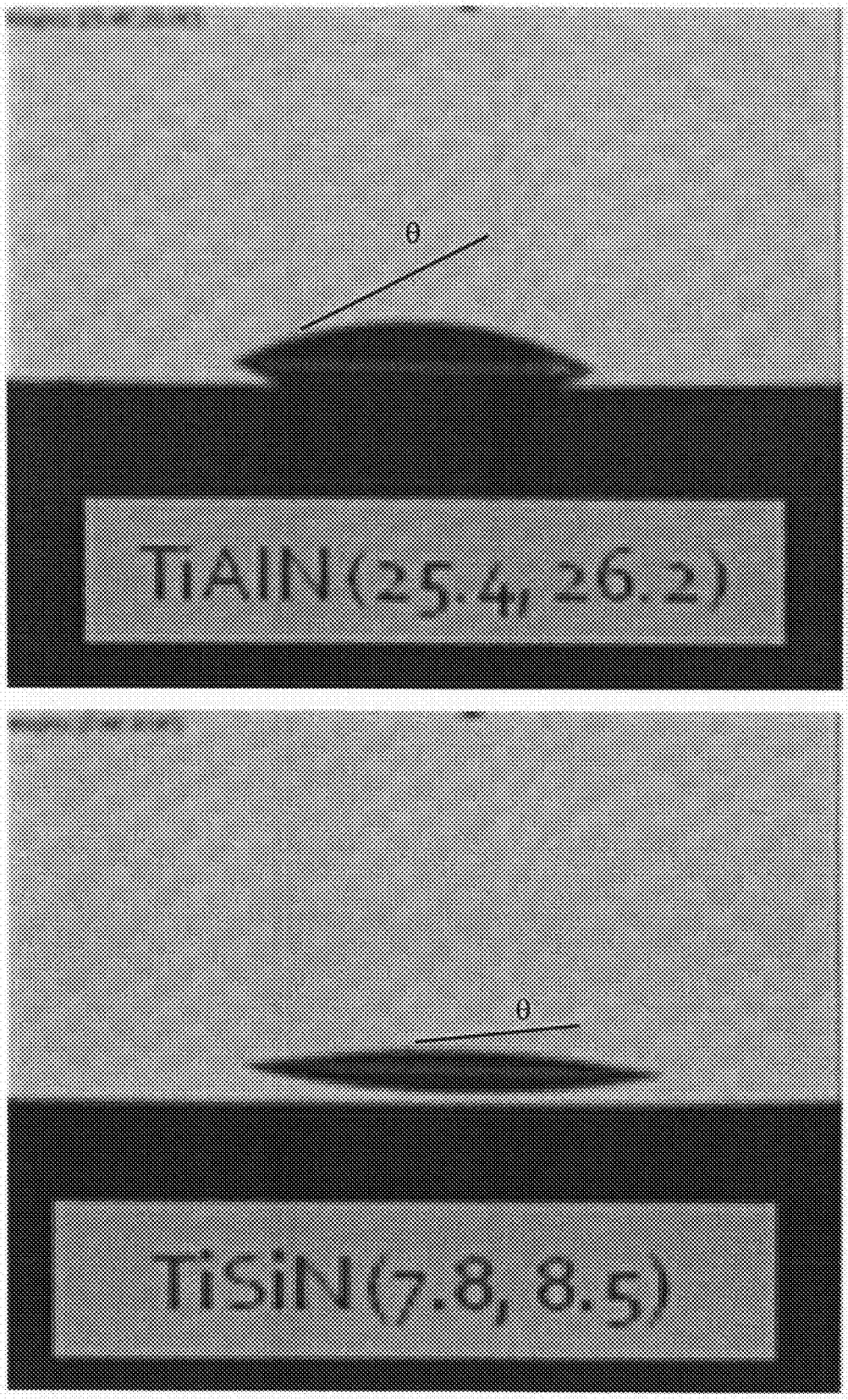
Figure 8 (b) – Mineral Oil droplets

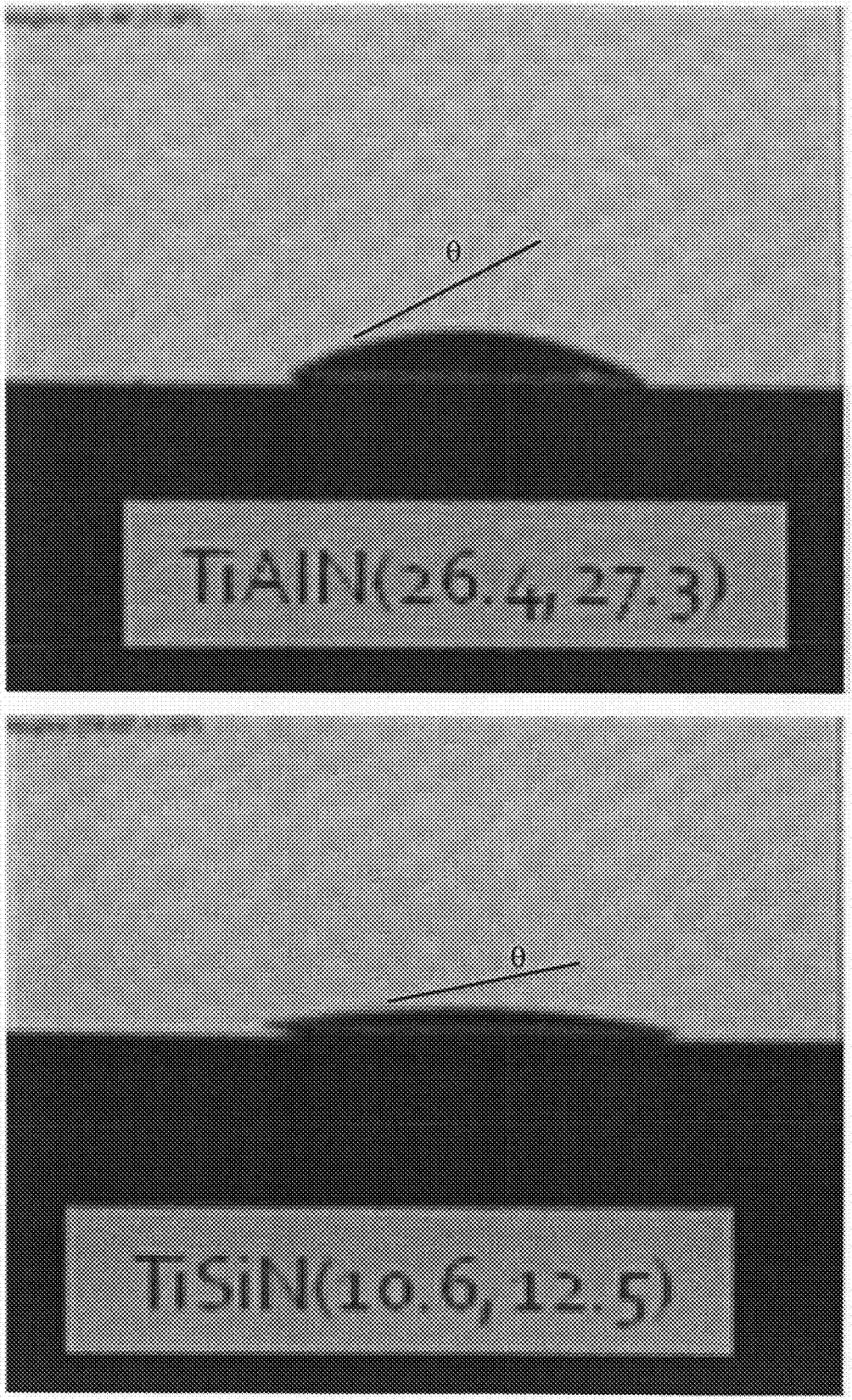
Figure 8 (c) – Vegetable Oil droplets

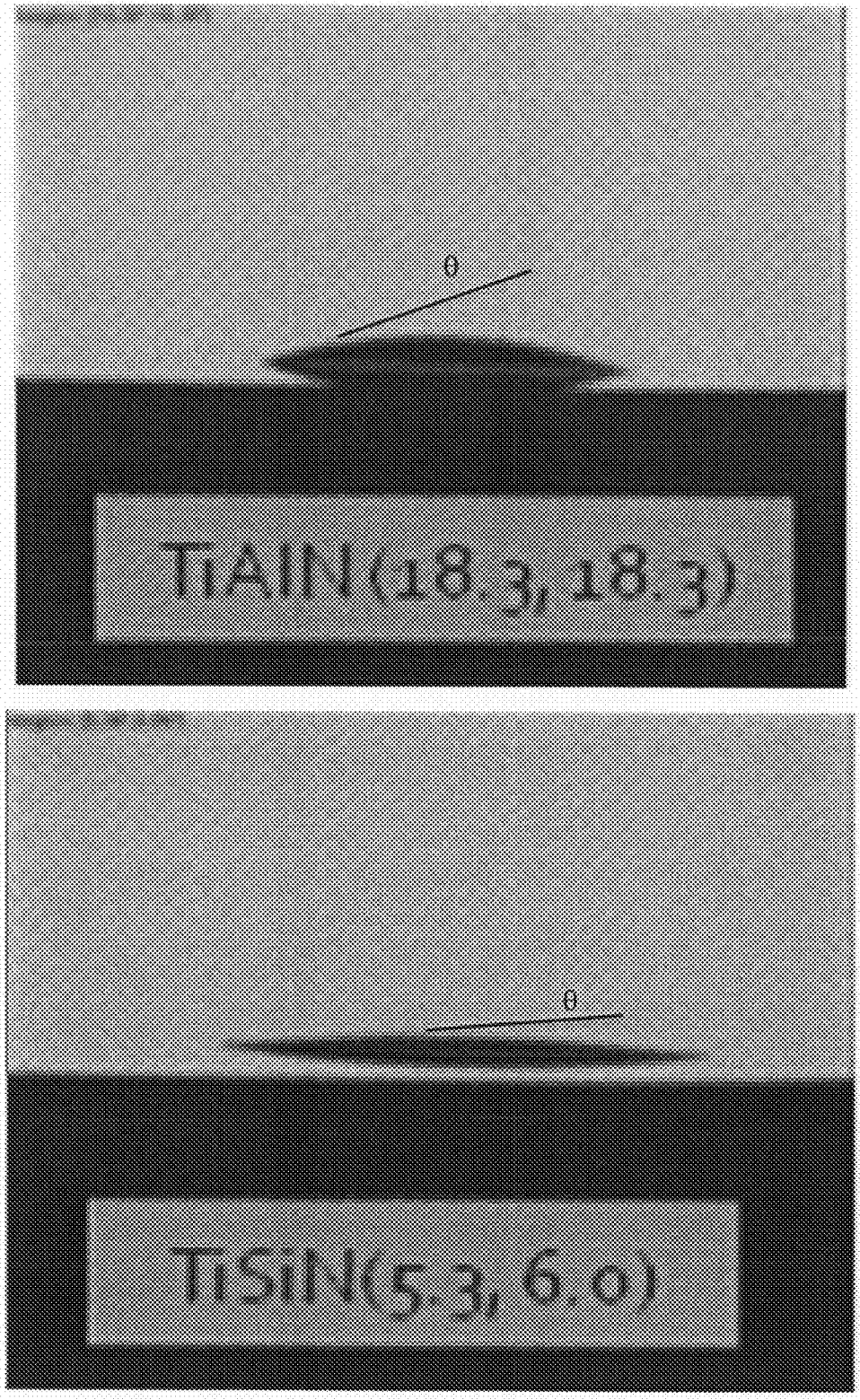
Figure 8 (d) – Vegetable Oil/EGN Material droplets

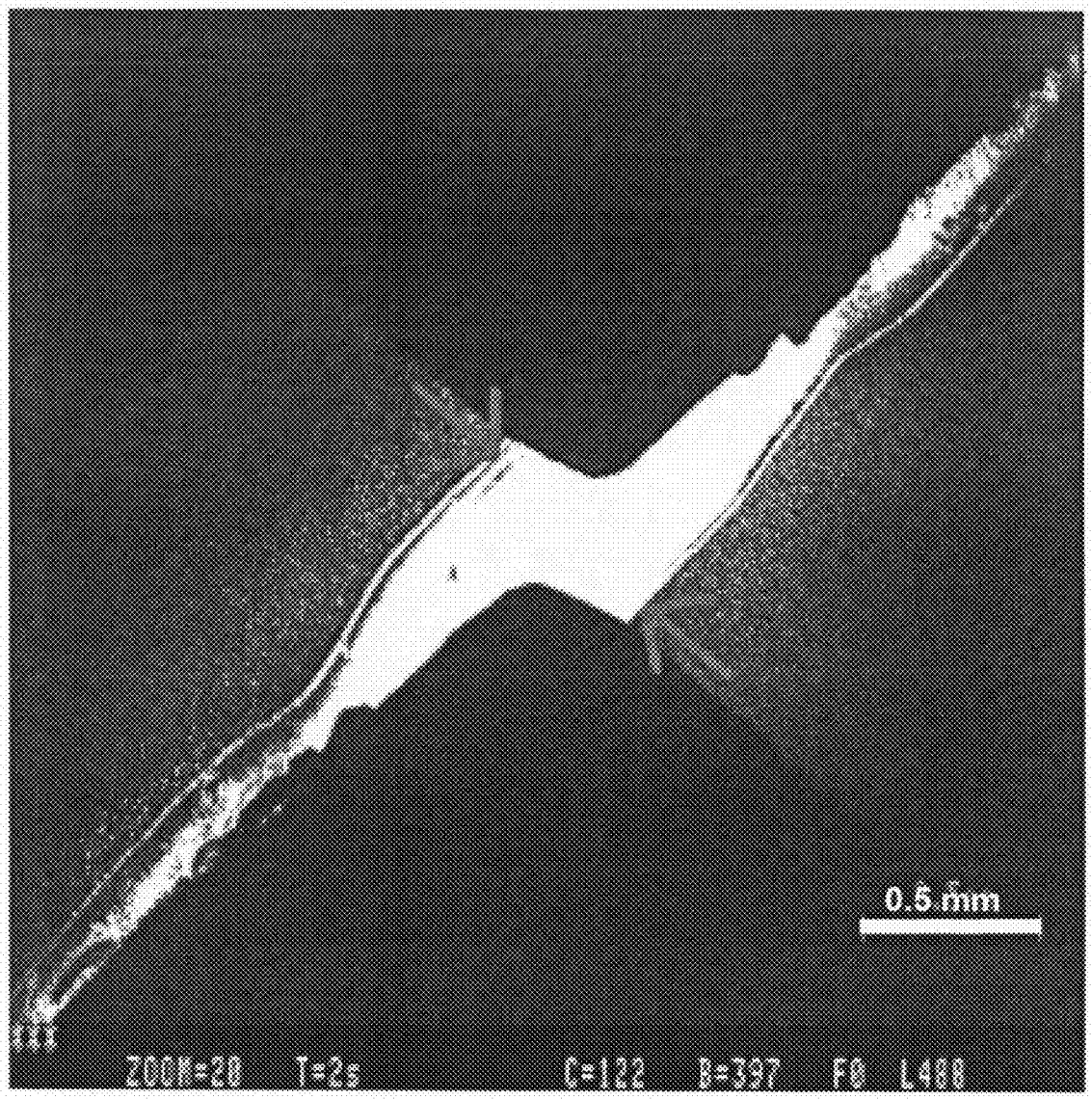
Figure 9 (a) – Central Wear

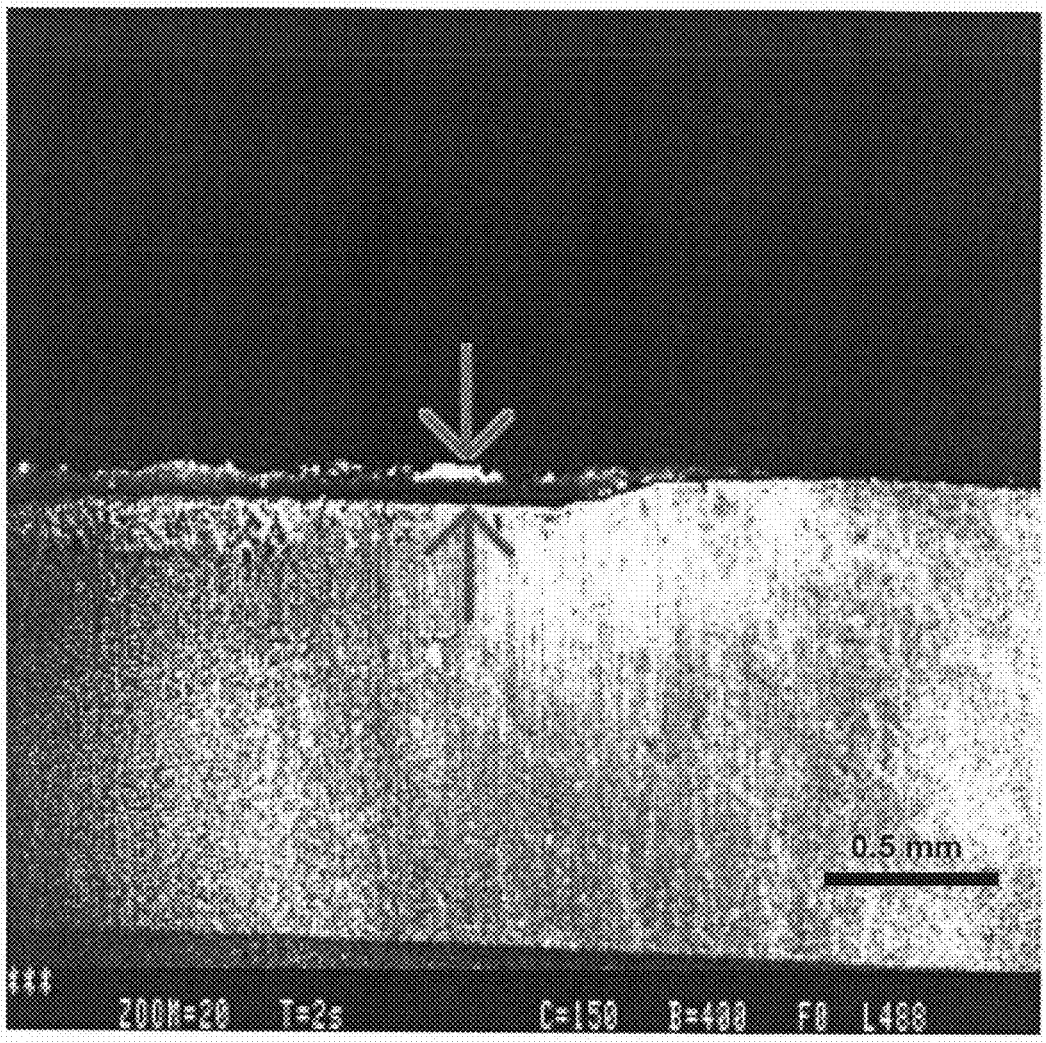
Figure 9 (b) – Flank Wear

NANOPARTICLE GRAPHITE-BASED MINIMUM QUANTITY LUBRICATION METHOD AND COMPOSITION

CROSS REFERENCE TO RELATED APPLICATION

This application claims priority to U.S. Provisional Patent Application No. 61/204,366, filed Jan. 6, 2009, which is incorporated herein by reference in its entirety.

BACKGROUND OF THE DISCLOSURE

1. Field of the Disclosure

The present disclosure provides a composition useful for Minimum Quantity Lubrication (MQL) during machining of a metal part. In particular, the present disclosure provides a composition which uses specially prepared exfoliated nanoparticle graphite platelets which enable stable mixing with the machining oil before or during the machining. The exfoliated graphite platelets can be prepared by microwave or radio frequency heating during removal of an intercalating agent between layers of the graphite and then pulverizing the exfoliated platelets without the agent to produce an exfoliated platelet with a thickness in the nanometer range between 0.1 nanometer to 100 nanometers and a platelet diameter in the range of 0.1 microns to 200 microns.

2. Brief Description of Related Technology

Cutting fluids have been widely used in metal cutting operations to extend tool life, improve surface finish and remove chip away from the cutting zone. In spite of the superior performance in using cutting fluids, some important concerns limit their usage. One of the major concerns is related to its disposal and subsequent negative impact on the environment. In that regard, new government policies have pointed towards the reduction or total elimination of cutting fluids. In addition to environmental concerns, the reduction or elimination of cutting fluids brings economical benefits for companies by reducing recycling operation and disposal cost.

Dry machining could be the ultimate solution that eliminates environmental and health concerns. However, the generation of particulate by-products and the ineffectiveness are the major drawback in the metal cutting process, especially when fine surface finish and aggressive cutting conditions are required [Sreejith 2000, Wakabayashi 2006]. In some operations such as machining aluminum alloys and stainless steels, cutting fluids are indispensable to avoid tool-work adhesion and built-up edge formation. In the particular case of cast materials, where low cutting forces and temperatures are expected, dry-machining is only possible for limited cutting conditions with certain types of cutting tools [Klocke 1997]. Thus, the ideal solution in the cutting fluid usage lies between dry machining and flood cooling. In this context, Minimum Quantity Lubrication (MQL) has been introduced as a viable method to practical machining processes.

MQL research is still in its infancy, and no clear direction has been established regarding the important parameters defining its effectiveness of MQL. Some researchers have focused their efforts to find the optimum type of lubricant in several works. For example, Heinemann et al. [2006] found that the mixture of water and a synthetic lubricant provided the longest tool life in deep-hole drilling. Wakabayashi et al. [2006] compared the MQL performance of synthetic esters and vegetable oil. The importance of these lubricants for MQL resides in their biodegradability and oxidation stability. Lopez et al. [2006] concluded that the optimal nozzle position in end milling formed a certain angle with the feed direction where the coolant can penetrate the cutting zone more efficiently. In fact, the tool wear reduction was observed when the oil mist was sprayed into the tool insert just before engagement. They also observed that by increasing oil flow rate flank wear was improved. Ueda et al. [2002] found that the appropriate nozzle orientation has a significant effect on reducing the cutting temperature on rake surface.

Itoigawa et al. [2006] proposed a new MQL lubricant, oil film on water droplet, to provide a large cooling ability. The nano-enhanced lubricants (nano-sized molybdenum disulfide ($MoS_2$) particles) for MQL described in Shen et al. [2008] applied to grinding processes. However, the dissociation temperature of $MoS_2$ is extremely low (at 350° C. in oxidizing environments), which will be a major problem for conventional machining applications.

Suda et al. U.S. Publication No. 2008/0026967 describes mixtures of oils for Minimum Quantity Lubrication (MQL). There is a suggestion of incorporating graphite in the oil but there are no examples. The problem is that the commercially available graphite is very difficult to mix with the oils after preparation by high temperature heating (800° C.-1000° C.) of the graphite over a substantial period of time. There is a need for better graphite particles which are more effective for MQL.

Objects

It is therefore an object of the present disclosure to provide a lubricant composition for use in MQL machining. It is further an object of the present disclosure to provide a method of machining using the lubricant composition at MQL process conditions. Another object is to improve the lubricity of current MQL lubricant compositions.

These and other objects may become increasingly apparent by reference to the following description.

SUMMARY

Exfoliated graphite nanoparticle (EGN) material is combined with a machining oil to form a lubricant composition suitable for performing a Minimum Quantity Lubrication (MQL) process to lubricate a surface, for example a metal-working tool surface during a machining process. The high aspect ratio of graphene platelets in the EGN material permits orientation of the graphene phase when applying the lubricant composition in the MQL process.

The disclosure relates to a lubricant composition comprising: (a) a machining oil; (b) an exfoliated graphite nanoparticle (EGN) material stably dispersed in the machining oil (e.g., such that the EGN material remains suspended in the machining oil for a period ranging from 5 days to 1000 days), and (c) optionally one or more additives selected from the group consisting of antimicrobial agents, biocides, fungicides, wetting agents, film-forming agents, antifoam agents, corrosion inhibitors, and combinations thereof. In an embodiment, the EGN material has been formed by (i) microwave or radio frequency heating of a graphite material for a time and at a power sufficient to remove an expanding agent intercalated between layers of the graphite material and then (ii) pulverizing the microwave- or radio frequency-heated graphite material. Suitably, (i) the EGN material is present in the lubricant composition in an amount ranging from 0.01 wt. % to 2 wt. % relative to the lubricant composition; (ii) the EGN material has a surface area ranging from 25 $m^2/g$ to 500 $m^2/g$; and/or (iii) the EGN material comprises EGN particles having (A) a diameter ranging from 0.5 μm to 30 μm, (B) a thickness ranging from 0.3 nm to 20 nm, and/or (C) a diameter-to-thickness aspect ratio ranging from 100 to 5000. In an embodiment, the EGN material contains at least 90% carbon and less than 10% oxygen (e.g., surface-bound oxygen).

In another embodiment, the disclosure relates to a lubricant composition comprising or consisting essentially of: (a) a machining oil comprising a vegetable oil present in an amount of at least 99 wt. % relative to the lubricant composition; (b) an exfoliated graphite nanoparticle (EGN) material stably dispersed in the machining oil, wherein: (i) the EGN material has been formed by (A) microwave heating of a graphite material for a time and at a power sufficient to remove an expanding agent intercalated between layers of the graphite material and then (B) pulverizing the microwave-heated graphite material; (ii) the EGN material is present in the lubricant composition in an amount ranging from 0.01 wt. % to 1 wt. % relative to the lubricant composition; (iii) the EGN material has a surface area ranging from 50 $m^2/g$ to 200 $m^2/g$; and/or (iv) the EGN material comprises EGN particles having (A) a diameter ranging from 1 μm to 20 μm, (B) a thickness ranging from 2 nm to 15 nm, and/or (C) a diameter-to-thickness aspect ratio ranging from 200 to 3000; wherein: (i) the EGN material is stably dispersed in the machining oil such that the EGN material remains suspended in the machining oil for a period of at least 200 days; and (ii) the lubricant composition has a first wetting angle when applied to a substrate, the first wetting angle being less than a second wetting angle for a corresponding lubricant composition without the EGN material when the corresponding lubricant is applied to the substrate.

Various machining oils can be used. In an embodiment, (i) the machining oil is a hydrophobic oil, and/or (ii) the lubricant composition is substantially free of hydrophilic liquids. Suitably, the machining oil is selected from the group consisting of ester oils (e.g., at least 98 wt. % relative to the lubricant composition, for example as the only oil present), hydrocarbon oils, and combinations thereof. The machining oil can comprise an ester oil selected from the group consisting of soybean oil, safflower oil, linseed oil, corn oil, sunflower oil, olive oil, canola oil, sesame oil, cottonseed oil, palm oil, peanut oil, coconut oil, rapeseed oil, tung oil, castor oil, almond oil, flaxseed oil, grape seed oil, olive oil, safflower oil, sunflower oil, walnut oil, and combinations thereof.

The disclosure also relates to a method of lubricating a tool, the method comprising: (a) providing a lubricant composition according to any of the variously disclosed embodiments; (b) contacting a tool (e.g., a cemented carbide or a ceramic tool) with a substrate (e.g., a metal workpiece) at a worksite; (c) applying the lubricant composition to the worksite in the form of a mist while contacting the tool with the substrate. Suitably, the lubricant composition is applied to the worksite in an amount sufficient to provide minimum quantity lubrication (MQL) at the worksite (e.g., in an amount ranging from 0.05 ml/min to 5 ml/min). The lubrication can be performed in a various machining processes such as cutting, grinding, drilling, rolling, forging, pressing, milling, turning, tapping, and/or punching. In an embodiment, the worksite during operation is at or above a vaporization temperature of the machining oil, thereby vaporizing at least a portion of the machining oil applied to the worksite while contacting the tool with the substrate.

The present disclosure provides a lubricant composition for machining a metal workpiece which comprises in a mixture: (a) a nanosized particulate graphite (NPG), which has been expanded by microwave heating for up to 5 minutes to remove an expanding agent intercalated between layers of graphite platelets and then pulverized to provide the NPG; and (b) machining oil provided by Minimum Quantity Lubrication (MQL), when the oil is applied as a mist with the NPG.

The present disclosure also provides a machining method (e.g., for making a metal workpiece) which comprises: (a) providing any on the foregoing lubricant compositions with the NPG in the machining oil comprising a nanosized particulate graphite (NPG), which has been expanded by microwave heating for up to 5 minutes to remove an expanding agent intercalated between layers of graphite platelets and then pulverized to provide the NPG; and (b) machining the metal workpiece with the tool with the composition wherein the machining oil is provided by Minimum Quantity Lubrication (MQL), when the oil is applied as a mist with the NPG. Preferably, there is between about 0.01 and 1% by weight of the NPG in the composition. Preferably, the particles are about 1 to 100 nanometers thick and about 0.1 to 200 microns in diameter on average. Preferably, there is between about 0.01 and 1% by weight of NPG in the composition. Preferably, the NPG are 1 to 100 nanometers thick and about 0.1 to 200 microns in diameter on average. Preferably, the composition is stable over time to keep the NPG suspended. Preferably, the composition is stable over a period of time to keep the NPG suspended.

All patents, patent applications, government publications, government regulations, and literature references cited in this specification are hereby incorporated herein by reference in their entirety. In case of conflict, the present description, including definitions, will control.

Additional features of the disclosure may become apparent to those skilled in the art from a review of the following detailed description, taken in conjunction with the examples, drawings, and appended claims, with the understanding that the disclosure is intended to be illustrative, and is not intended to limit the claims to the specific embodiments described and illustrated herein.

BRIEF DESCRIPTION OF THE DRAWINGS

For a more complete understanding of the disclosure, reference should be made to the following detailed description and accompanying drawings wherein:

FIG. 8 illustrates wetting angle measurements of various machining lubricant droplets on different substrates (a: water droplets, b: mineral oil droplets, c: vegetable oil droplets, d: vegetable oil with EGN material). Substrate coating materials include TiAlN (left) and TiSiN (right). Numbers in parentheses indicate the wetting angle measurements from the left and right edges of each image.

FIG. 9 illustrates the measurement of central wear (A) and flank wear (B) (scale bar: 0.5 mm).

Figure 1:
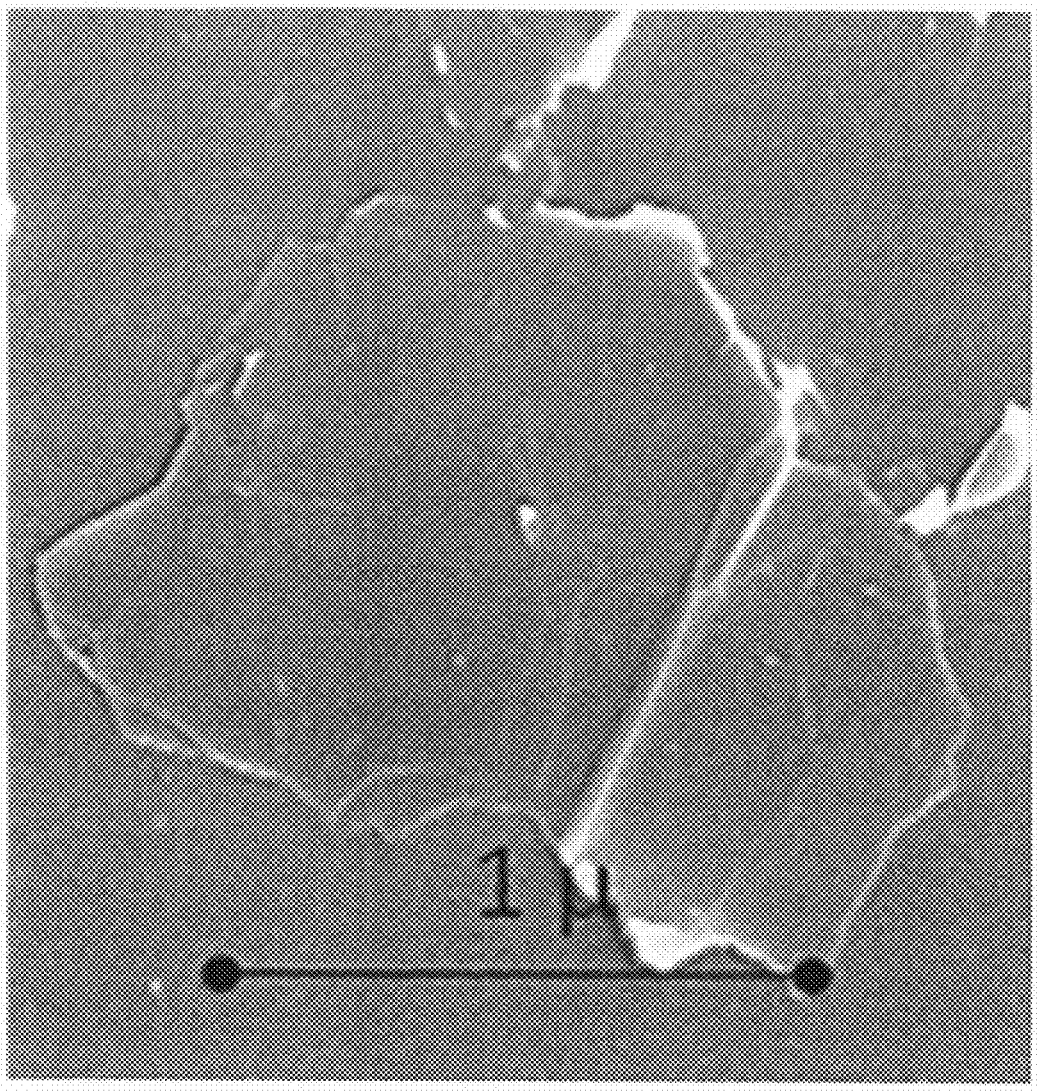
FIG. 1 includes SEM (A) and TEM (B) images of exfoliated graphite nanoparticles/nanoplatelets.
Figure 1:
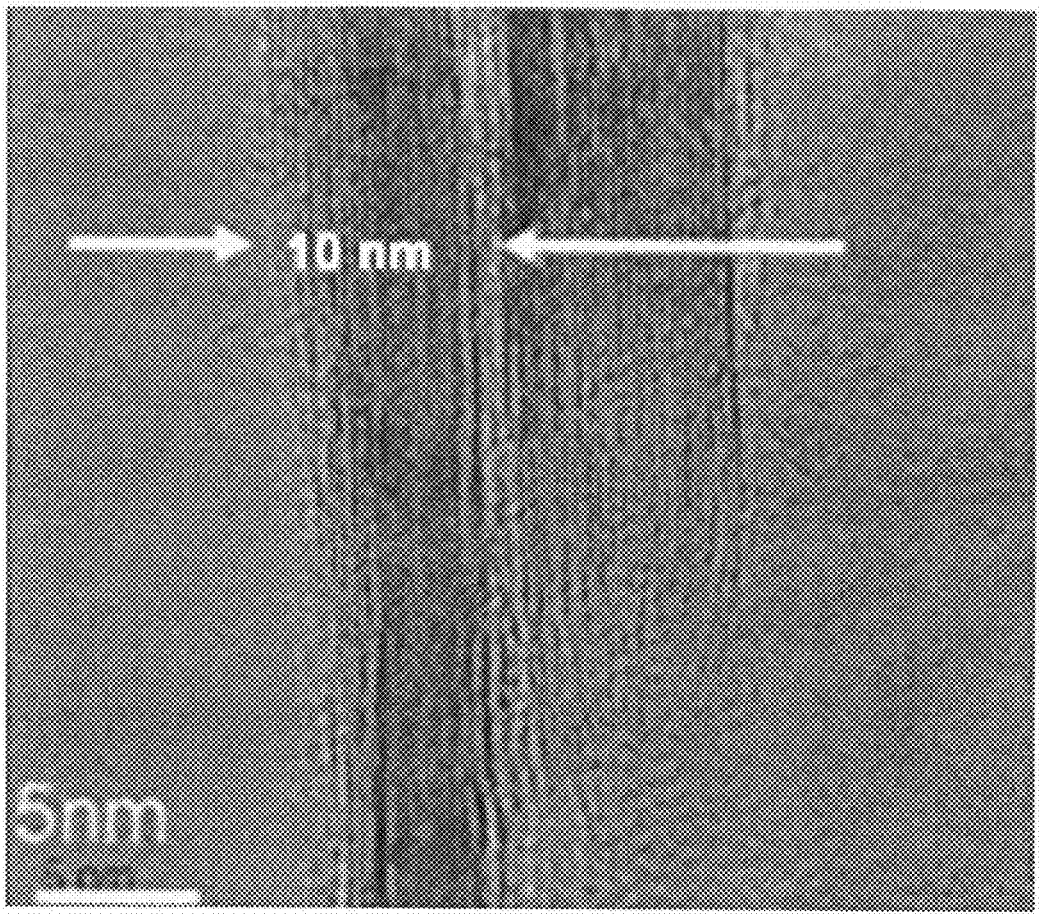

While the disclosed compositions and methods are susceptible of embodiments in various forms, specific embodiments of the disclosure are illustrated in the drawings (and will hereafter be described) with the understanding that the disclosure is intended to be illustrative, and is not intended to limit the claims to the specific embodiments described and illustrated herein.

DETAILED DESCRIPTION

Minimum Quantity Lubrication (MQL) is a method of applying a small amount of a machining oil (including petroleum derived products) as a liquid lubricant in a mist form during machining. Compared to the flood cooling method typically practiced in industries, MQL does not require many harmful chemicals, centralized pumping unit and eventual disposal of lubricants. However, a drawback of MQL is that the machining tools (e.g., tools such as cutting tools) are being heated during the machining operation and the oil mist from MQL evaporates during aggressive cutting conditions typically being used in machining and forming. MQL has significant cost and material benefits if a suitable lubricant with attractive performance attributes is available.

The disclosure relates to a lubricant composition that includes (a) a machining oil (e.g., a liquid lubricant) and (b) an exfoliated graphite nanoparticle (EGN) material stably dispersed in the machining oil. The lubricant composition is a stable suspension of the EGN material in the machining oil and is suitable for use as a liquid lubricant in a Minimum Quantity Lubrication (MQL) process. In the MQL process, the lubricant composition is applied/transferred to a worksite in the form of a mist. The worksite is the location/interface where two surfaces contact each other, for example a working surface of a tool contacting a substrate to be worked (e.g., a metal workpiece) in a machining operation. The presence of the EGN material in the lubricant composition provides high-temperature stability and lubricity under MQL conditions. A very small amount is transferred especially at high cutting speeds where the mist of the machining oil evaporates, but the EGN material remains on the surface to provide lubricity. Any operation involving machining can benefit from this lubricant composition.

The lubricant composition is suitably formed by mixing the machining oil and the EGN material in any convenient amounts and manner to provide a stable dispersion. Lubricating and machining benefits can be obtained when the EGN material is included in the lubricant composition in relatively small amounts, for example at least 0.01 wt. %, 0.02 wt. %, or 0.05 wt. % and/or up to 0.2 wt. %, 0.5 wt. %, 1 wt. %, 1.5 wt. %, or 2 wt. % based on the weight of the lubricant composition. In an embodiment, the substantial remainder of the lubricant composition is the machining oil, and the machining oil is included in the lubricant composition in relatively large amounts, for example at least 95 wt. %, 98 wt. %, 99 wt. %, 99.5 wt. %, 99.8 wt. %, or 99.9 wt. % based on the weight of the lubricant composition. While a suitable lubricant composition can be obtained with a substantially two-component mixture (i.e., machining oil and EGN material), minor amounts (e.g., present up to 0.01 wt. %, 0.1 wt. %, or 1 wt. % based on the weight of the lubricant composition) of one or more conventional machining lubricant additives such as biocides (e.g., antimicrobial agents and fungicides such as isothiazolinones), wetting agents, film-forming agents, anti-foam agents, and/or corrosion inhibitors can be included in the lubricant composition.

Any suitable mixing technique can be used to combine the machining oil and the EGN material. High-shear mixing and/or sonication techniques (e.g., using ultrasound) can be used to form the lubricant composition from its constituents. The resulting lubricant composition is a stable dispersion of the EGN material in the machining oil. In various embodiments, the EGN material remains stably suspended in the machining oil/lubricant composition for a period of at least 5 days, 15 days, 30 days, 60 days, 100 days, or 200 days and/or up to 60 days, 100 days, 200 days, 300 days, 500 days, or 1000 days. For example, after and/or up to a specified number of days, there is no visually observable segregation, agglomeration, or separation of the EGN material in the machining oil. For example, even at an EGN material concentration of 0.1 wt. %, the lubricant composition appears as a homogeneously mixed grayish black composition (i.e., instead of the natural color of the machining oil alone). Eventual separation can be visually detected in the lubricant composition based on settling of the EGN material (i.e., to a form a graphite-rich lower layer and an upper layer having a reduced amount of graphite that appears to be machining oil alone). In contrast, other forms of commercially available graphite (e.g., after preparation with high-temperature heating such as between 800° C. and 1000° C.) are difficult to mix in various machining oils without settling.

The inclusion of the EGN material in the lubricant composition generally improves the adhesion properties of the lubricant composition to a substrate, in particular relative to a corresponding lubricant composition that omits the EGN material. This improved adhesion property can be expressed in terms of the resulting wetting angle when the lubricant composition is applied to a substrate. In particular, the lubricant composition that includes the EGN material has a first wetting angle $\theta_1$ when applied to a substrate, and the first wetting angle is less than a second wetting angle $\theta_2$ for a corresponding lubricant composition without the EGN material when the corresponding lubricant is applied to the same substrate. The reduction in wetting angle additionally can be expressed by the ratio $(\theta_2-\theta_1)/\theta_2$, which suitably ranges from 0.1 to 0.7, 0.2 to 0.6, or 0.3 to 0.5.

Exfoliated Graphite Nanoparticle (EGN) Material

The exfoliated graphite nanoparticle (EGN) material is derived from a graphite material such as natural graphite, synthetic graphite, and/or highly oriented pyrolitic graphite. The EGN material is suitably formed by exfoliating the starting graphite material (e.g., by microwaving). Additionally, the exfoliated graphite can then be pulverized (or subjected to another size-reduction technique) to obtain a desired size distribution of the EGN material. An expanded graphite is one which has been heated to separate individual platelets of graphite with or without an expanding agent (e.g., a chemical intercalant between layers of graphite such as an acid intercalant). An exfoliated graphite is a form of expanded graphite where the individual platelets are separated by heating with or without an agent (e.g., a polymer or polymer component). The graphite can be heated with conventional (thermal) heating, microwave (MW) energy, or radiofrequency (RF) induction heating. The microwave and radiofrequency methods provide a fast and economical method to produce exfoliated graphite. The combination of microwave or radiofrequency expansion and an appropriate grinding technique (e.g., planetary ball milling, vibratory ball milling), efficiently produces nanoplatelet graphite flakes with a high aspect ratio (e.g., up to 100, 1000, 10000 or higher), a high surface area (e.g., at least 25 $m^2/g$, 50 $m^2/g$, 75 $m^2/g$, or 100 $m^2/g$ and/or up to 150 $m^2/g$, 200 $m^2/g$, 300 $m^2/g$, and/or 500 $m^2/g$), and a controlled size distribution. Chemically intercalated graphite flakes are rapidly exfoliated by application of the microwave or radiofrequency energy, because the graphite rapidly absorbs the energy without being limited by convection and conduction heat transfer mechanisms. For example, microwave heating for a sufficient time (e.g., for times up to 5 minutes and/or as low as 1 second) at a suitable microwave power exfoliates the graphite and removes/boils the expanding intercalating chemical. Additional details regarding the formation of the EGN material may be found in Drzal et al. U.S. Publication Nos. 2004/0127621, 2006/0148965, 2006/0231792, and 2006/0241237 (incorporated herein by reference).

The graphite material suitably has not been oxidized, and thus contains only a minor amount of oxygen in the carbon network (e.g., resulting from natural oxidation processes and/or mechanical size reduction processes). As a result, the EGN material formed from the graphite material also has a minor amount of oxygen (e.g., surface-bound oxygen at exposed surfaces of the of the EGN material). Suitably, the EGN material (or starting graphite material) contains less than 10%, 8%, 5%, or 3% oxygen (on a number or weight basis), although residual amounts of oxygen ranging from 0.1%, 1%, or 3% or more are not uncommon at the lower end. Similarly, the EGN material suitably is free (or substantially free) of other functionalizing atoms or groups (e.g., nitrogen, halogens) that either are intentionally added to the EGN material or a result of natural impurities. Alternatively or additionally, the EGN material (or starting graphite material) can be characterized as containing at least 90%, 92%, 95%, or 97% carbon (on a number or weight basis).

The EGN material according to the disclosure generally includes a single graphene sheet or multiple graphene sheets stacked and bound together. Each graphene sheet, also referred to as a graphene plane or basal plane, has a two-dimensional hexagonal lattice structure of carbon atoms. Each graphene sheet has a length and a width (or, equivalently, an approximate diameter) parallel to the graphene plane and a thickness (e.g., an average thickness) orthogonal to the graphene plane. Particle diameters generally range from the sub-micron level to over 100 microns (e.g., 0.1 μm to 200 μm or 1 mm; such as 0.5 μm or 1 μm to 20 μm or 30 μm, 2 μm to 15 μm, 3 μm to 10 μm; alternatively or additionally 0.5 μm to 2 μm, 5 μm to 100 μm, 8 μm to 80 μm, 10 μm to 20 μm, or 10 μm to 50 μm). The thickness of a single graphene sheet is about 0.3 nm (e.g., 0.34 nm). Individual EGN material particles (or platelets) used herein can include either single graphene sheet or multiple graphene sheets, and thus the thickness of the EGN material particles can generally range from 0.3 nm to 20 nm, or 0.3 nm to 10 nm or 15 nm (e.g., up to 2 nm, 4 nm, 6 nm, 8 nm, 10 nm, 12 nm, 15 nm, or 18 nm and/or at least 0.3 nm, 0.5 nm, 1 nm, 2 nm, 3 nm, 6 nm, 9 nm, or 12 nm). Alternatively, the thickness of the EGN material particles can be expressed in terms of the number of stacked graphene sheets they contain, for example 1 to 60 or 1 to 30 (e.g., 2 to 50, 3 to 40, or 5 to 30). The EGN material platelets preferably have an aspect ratio of at least 100, for example at least 200, 300, 500, 1000 or 2000 and/or up to 3000, 5000, or 10000. The aspect ratio can be defined as the diameter-to-thickness ratio or the width-to-thickness ratio (e.g., with the width being a characteristic (such as average or maximum) dimension in the graphene plane). A population of EGN material platelets (or other nanoparticles) can have a distribution of characteristic size parameters (e.g., diameter, thickness, aspect ratio), and the various property ranges can generally apply to the boundaries of the distribution (e.g., upper and lower boundaries such as 1%, 5%, or 10% lower and/or 90%, 95%, or 99% upper cumulative distribution boundaries) and/or the average of the distribution, where the distribution can be based on number, volume, or mass. Suitable EGN material particles are available from XG Sciences, Inc. (East Lansing, Mich.) and generally have a thickness of about 5 nm (e.g., average thickness of 4 nm to 6 nm with a thickness distribution ranging from 1 nm to 15 nm).

Machining Oils

The machining oils that can be used in the lubricant composition are not particularly limited and can include those generally known in the art as machining lubricants, whether in the context of an MQL machining process or a machining process employing flood cooling/lubrication. In an embodiment, the machining oil is a hydrophobic oil, generally being formed from hydrocarbon chains, although some degree of polar functionality (e.g., via ester functional groups) may be present in the hydrophobic oil. Accordingly, the machining oil and lubricant composition can be substantially free (e.g., less than 1 wt. %, 0.1 wt. %, or 0.01 wt. %) of hydrophilic liquids (e.g., water, lower alcohols such as $C_1$-$C_5$ alkanols). Although such hydrophilic liquids can have a higher specific cooling capacity (e.g., based on their heat of vaporization) than the machining oils relative to their ability to remove heat from the tool-substrate interface, they tend to have a lower viscosity (which promotes composition instability/settling) and a lower vaporization temperature (which limits the ability of the liquid to provide a lubricating effect). Examples of suitable hydrophobic oils include ester oils and/or hydrocarbon oils. In a particular embodiment, an ester oil such as a vegetable oil (or a refined mixture derived therefrom) is the only machining oil present in the composition. For example, the ester oil can account for at least 95 wt. %, 98 wt. %, 99 wt. %, 99.5 wt. %, or 99.9 wt. % of the total machining oil present (or alternatively of the total lubricant composition). Various other suitable machining oils that can be used alone or in combination are disclosed in U.S. Publication No. 2880/0026967 (incorporated herein by reference).

The ester oil is not particularly limited, and generally includes two or more hydrocarbon chains joined by one or more ester linkages, for example molecules having from 1 to 3 ester linkages and 4 to 70 carbon atoms (e.g., 3 ester linkages and 40 to 65 carbon atoms for triglyceride ester oils such as common natural fatty acid triglycerides). The ester oil can be derived from a natural source (e.g., natural fat or oil such as animal- or vegetable-based fats and/or oils) or can be a synthetic ester (e.g., mono- or poly- (in particular di- or tri-) esters of alcohols (or polyhydric alcohols) and carboxylic acids). Examples of vegetable-based fats/oils include vegetable oil triglycerides such as soybean oil, safflower oil, linseed oil, corn oil, sunflower oil, olive oil, canola oil, sesame oil, cottonseed oil, palm oil, peanut oil, coconut oil, rapeseed oil, tung oil, castor oil, almond oil, flaxseed oil, grape seed oil, olive oil, safflower oil, sunflower oil, and/or walnut oil. Examples of animal-based fats/oils include animal oil triglycerides such as fish oil, tallow (beef, mutton), lard, suet (beef, mutton), neatsfoot oil, bone oil, and/or butter oil.

Alternatively or additionally, the ester oil, whether from a natural or synthetic source, can be characterized as a mono-, di-, or tri-ester of (a) an alcohol (e.g., $C_1$-$C_{24}$, $C_1$-$C_{16}$, or $C_1$-$C_8$ mono-alcohol) or a polyhydric alcohol (e.g., $C_2$-$C_{12}$ or $C_2$-$C_6$ diols and triols, glycerin) with (b) one to three fatty acids (e.g., $C_6$-$C_{24}$, $C_{10}$-$C_{24}$, or $C_{10}$-$C_{20}$ saturated or unsaturated fatty acids). Mixtures of the various natural and synthetic ester oils also may be used as the machining oil.

The hydrocarbon oil is not particularly limited, and generally can include hydrocarbons (e.g., aliphatic and/or aromatic) distributed in a range from $C_5$ to $C_{40}$. Suitable hydrocarbon oils include mineral oils and synthetic oils. Examples of mineral oils include paraffin-based mineral oils or naphthene-based oils. Examples of synthetic oils include polyolefins (e.g., oligomers of alkenes such as ethylene, propylene, butene, and/or isobutene) and alkylaromatic compounds (e.g., mono- and/or poly-alkylated benzene and/or naphthalene).

Tool Lubrication

Figure 7:
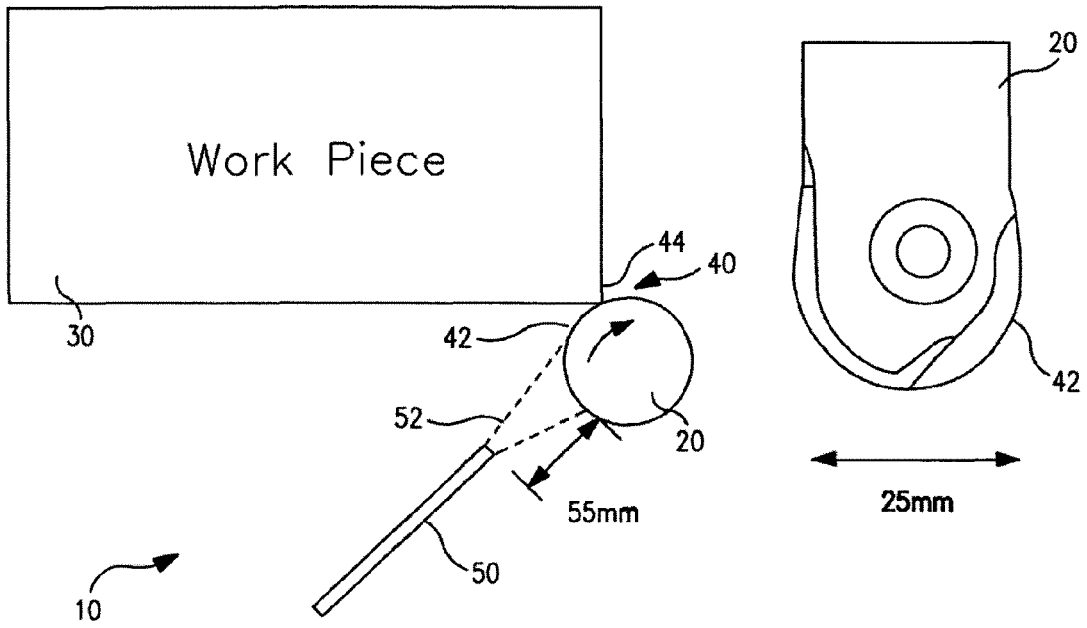
FIG. 7 illustrates a lubricating/machining process using the lubricant composition according to the disclosure.

The lubricant composition in any of its various embodiments can be used to lubricate a tool, for example in a machining process. A generic lubricating system 10 representative of any of a variety of machining processes is illustrated in FIG. 7 (dimensions shown in relation to a specific example subsequently described). The lubricating system 10 includes a tool 20, a substrate 30, and a lubricant applicator 50. In a machining process (e.g., cutting, grinding, drilling, rolling, forging, pressing, milling, turning, tapping, punching), the appropriate tool 20 (e.g., the particular ball nose insert 20 shown in FIG. 7) is contacted with the substrate 30 to be worked by the tool (e.g., a metal workpiece). The tool 20 and the substrate 30 are contacted at a worksite 40, which more generally denotes the region where a working surface 42 (e.g., a cutting blade) of the tool 20 and a surface 44 of the substrate 30 to be worked by the tool 20 are in contact or in close proximity. During operation (e.g., while the tool 20 and substrate 30 are in contact), the applicator 50 (e.g., a spray nozzle) is positioned so that the applicator 50 delivers/applies the lubricant composition to the worksite 40 (e.g., in particular the working surface 42 of the tool 20) in the form of a mist 52 (or other dispersion of droplets). The lubricant composition can be delivered as the mist 52 to the worksite 40 by any convenient method, for example by using a pressurized carrier gas (e.g., compressed air). The lubricating system 10 can be incorporated into a more general machining system with other conventional components (not shown), for example: (a) feed lines and/or reservoirs for supplying the pressurized carrier gas and the lubricant composition to the applicator 50, (b) a table or other support structure for mounting the substrate 30, and (c) an apparatus base or support structure for mounting the table (i.e., including the substrate 30), the tool 20, and the applicator 50 in a desired spatial arrangement relative to each other (i.e., whatever is appropriate for the particular machining process to be implemented). During operation, the tool 20 and the substrate 30 are moved relative to each other (e.g., with one or both moving relative to the fixed apparatus base) to complete the machining process. Suitably, the tool 20 and the applicator 50 are held in a fixed position relative to each other during the machining process (i.e., to facilitate the positioning of the applicator 50 that delivers the lubricant composition to the working surface 42 in a desired manner), and the substrate 30 is moved during the machining process.

The specific operating conditions of a given lubricating/machining process are not particularly limited. In general, the lubricant composition is applied to the worksite 40 in an amount sufficient to provide minimum quantity lubrication (MQL) at the worksite 40 (e.g., at or above an amount so that the mist 52 sufficiently covers the worksite 40 and the working surface 42 to provide a lubricating effect, yet is low enough to avoid flooding conditions). For example, in a common machining operation, the lubricant composition can be applied to the worksite 40 in an amount ranging from 0.05 ml/min to 5 ml/min (or alternatively 0.01 $cm^3/(cm^2 \cdot min)$ to 1 $cm^3/(cm^2 \cdot min)$ expressed as a flux per unit area of MQL spray application at the worksite 40). Heat generation during a machining process often can be above a vaporization temperature (or flash point) of the machining oil. In such a case, however, even when a portion of the machining oil (or all of the machining oil) is vaporized upon contact with the tool 20, substrate 30, and/or worksite 40, the EGN material particles remain on the working surfaces of the machining components. In such a case, the flat, lamellar nature of the EGN material particles (i.e., as reflected by their high aspect ratio) permits the particles to align with and adhere to the working surfaces of the machining components. As a consequence, the residual remaining EGN material particles coat the working surfaces and provide a lubrication effect resulting from the sliding of adjacent graphene sheets within a single particle. Specifically, the particles are deposited onto the working surface 42 in a way that exposes the top surface of individual particles, thus allowing each layer within a particle to slide against other adjacent layers within the particle to provide the lubrication effect.

The particular materials that can be used either as the tool 20 (e.g., forming the working surface 42 or forming a coating for the working surface 42) or the substrate 30 (e.g., when the substrate 30 is a metal workpiece) are not particularly limited. In general, they can include any ferrous (e.g., steel, stainless steel) or non-ferrous metals (e.g., aluminum, titanium), metal alloys thereof, and/or metal-containing compounds thereof (e.g., ceramics such as compounds including nitrogen, oxygen, and/or silicon) that are appropriate for a particular machining operation. The tool 20 can more generally be formed from other materials, such as ceramics and cemented carbides. Additionally, the tool 20 (e.g., the working surface 42) can be coated with a metal- or carbon-containing coating to preserve the life of the tool 20 (e.g., titanium-containing materials such as TiN, TiC, TiCN, TiAlN, and/or TiSiN, carbon-based coatings such as diamond).

EXAMPLE

The following example illustrates the disclosed compositions and methods, but are not intended to limit the scope of any claims thereto.

EGN material was suspended in machining oil for use as a cutting fluid. A stable suspension of exfoliated graphene (i.e., the EGN material) and machining oil was reached with a 1 μm diameter EGN material at 0.1% by weight concentration in the lubricating composition. The main advantage of using the machining oil with the graphene particles came during high heat operation. The flash point of the oil used was 200° C. If this temperature was exceeded, then the oil vaporized and did not provide effective lubrication without the EGN material. In the case of an oil-graphene mixture, the graphene particles were left behind even though the oil vaporized off. The result was that the graphene provided lubricity to the tool.

This example evaluates an MQL ball-milling test performed with a lubricant composition including the EGN material stably dispersed in the vegetable-based machining oil. The milling process was finishing, and the machining was done on a Sharnoa CNC mill (Auburn Hills, Mich.) using a Hitachi Ball Nose End Mill with a TiAlN or TiSiN coating. Two preliminary tests for the MQL machining process were conducted with the machining oil alone (i.e., without the EGN material) to determine suitable application parameters. First, wetting angles for a variety of commercially available lubricants and coated inserts were tested to determine whether the wetting angle would affect an MQL machining process. Second, the droplet distribution on a nominally flat surface was measured to provide adequate coverage of the lubricant composition on a cutting tool. Third, the results from the foregoing tests were used to determine suitable MQL process parameters for the EGN material-containing lubricant composition.

The exfoliated graphite nanoparticle (EGN) material used in the examples is fabricated from acid-intercalated expandable graphite using a microwave exfoliation process (e.g., as disclosed in Drzal et al. U.S. Publication Nos. 2004/0127621, 2006/0148965, 2006/0231792, and 2006/0241237, incorporated herein by reference) and commercially available through XG Sciences, Inc. (East Lansing, Mich.). A graphene nanoplatelet, whose diameter and thickness are 1 micrometer and 10 nanometers, respectively, is shown in FIG. 1. The thickness of the EGN material suitably can be selected from 1 nm to 15 nm, while the diameter of the EGN material suitably can range from the sub-micron level to the order of tens of microns. Consequently, the specific surface area of the EGN material can range from tens to hundreds of $m^2/g$. An advantage of the EGN material is its high aspect ratio as seen in FIG. 1. Thus, when used in an MQL machining process, the larger-sized surface of the particles (i.e., the large, flat surface generally defining the particle diameter as shown in FIG. 1(A)) will adhere to the surface of a tool or work material. The machining lubricity of the EGN material comes from the sliding of one graphene sheet over another.

The machining oil used in the examples was a vegetable-based oil commercially available from UNIST, Inc. (Grand Rapids, Mich.; a composition of mixed esters of naturally occurring refined fatty acids and esters thereof without additives provided under the name COOLUBE 2210 or 2210EP) The MQL oil lubricant composition was prepared by mixing the machining oil and the EGN material in a high shear mixer (SpeedMixer DAC 150FVZ-K from FlackTek, Inc.; Landrum, S.C.) having an attached ultrasonic homogenizer and a continuous flow cell to generate a stable suspension. The suspension was observed to be stable for more than seven days. In some conditions, the stability of the EGN material in the lubricant composition was sustained more than six months, indicating the wide applicability of the inclusion of EGN material in an MQL lubricant composition.

The MQL spray mist applicator for the lubricant composition was provided by UNIST, Inc. (Grand Rapids, MI). A transparent tube is used to measure the feed rate of the lubricant composition and the UNIST machine generates a mist of the lubricant composition containing the EGN material to be applied to work materials in a machining process. In a lathe operation, the cutting surface is not exposed, however, in milling operations, the lubricant suspension can be introduced into the tool-work material interface. The spray mist applicator is intended for the application of a vegetable-based lubricant oil, and the spray is dispensed through an external co-axial nozzle. The liquid mist output can be adjusted both manually with the air metering screw and remotely by the metering pump knob which is in turn controlled by pulse generator in the control panel. This pulse generator allows automatic, infinite repeat cycling of the lubricant pump from a single air source. The air metering screw controls the air flow from the nozzle, which determines the droplet density and distance of the spray. The air pressure was measured at the output pressure gauge, and the spray output has an included angle of approximately 11-32 degrees, depending on the amount of air introduced. Thus, the coverage area of the applied lubricant composition can be finely adjusted by using the air output and frequency controls.

Figure 2:
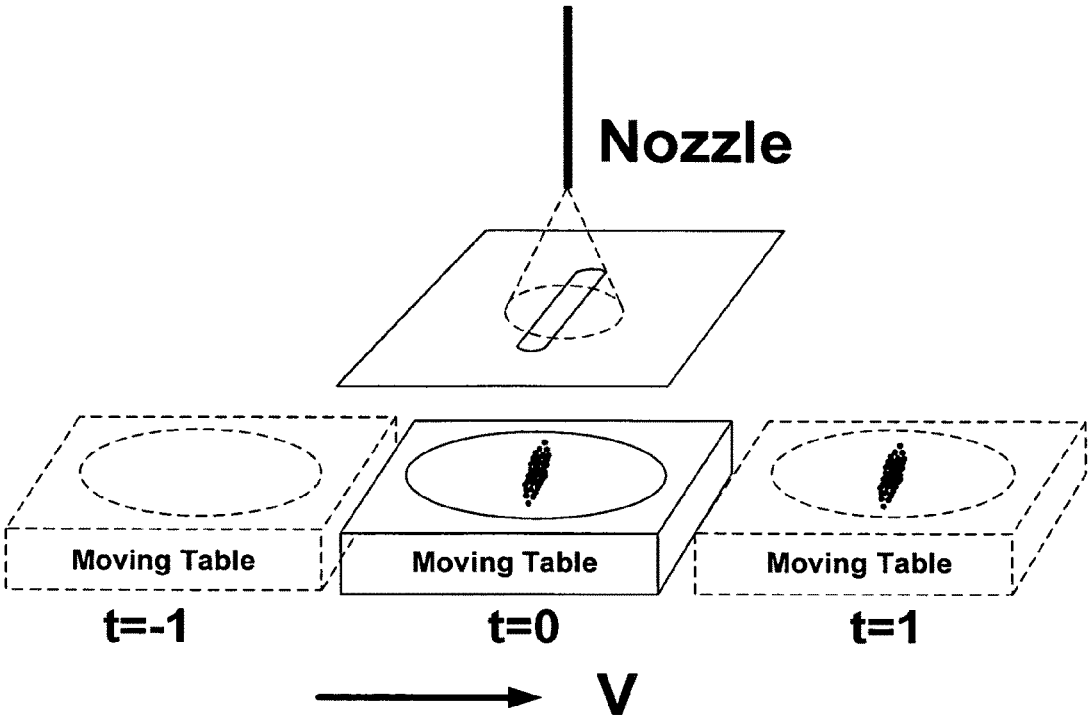
FIG. 2 illustrates the system for obtaining the distribution of droplets applied to a substrate.

Droplet Distribution: FIG. 2 depicts the oil spray method used to measure the size and distribution of droplets applied by the MQL spray mist applicator. As soon as droplets pass through the opening in the screening plate, they are collected onto a silicon wafer mounted on a CNC table. The main function of the screening plate is to prevent the excessive overlap of droplets due to the continuous flow of mist. Once the droplets are collected on the wafer, they are immediately imaged using a Zeiss LSM210 laser scanning microscope system to produce the 2D microscope images and height-encoded (HE) images for 3D topography.

Figure 3:
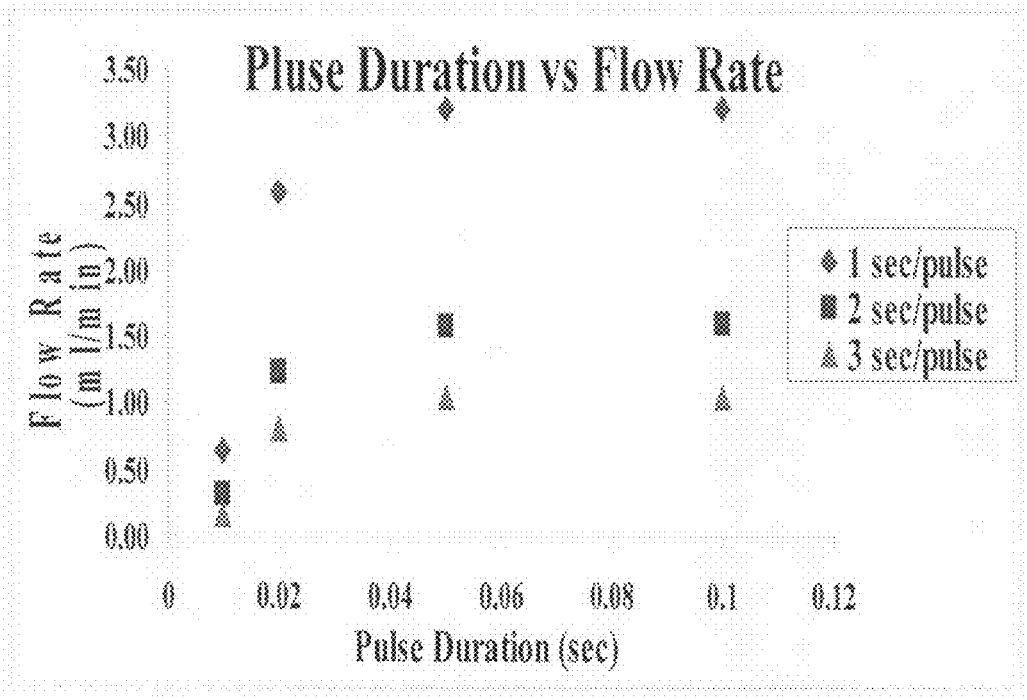
FIG. 3 is a graph illustrating the flow rate of the lubricant composition as a function of pulse rate (e.g., "2 sec/pulse" in the legend indicates one pulse every 2 seconds or 0.5 Hz) and pulse duration (in seconds).

The flow rate of oil mist can be determined based on the pulse duration and pulse frequency shown in FIG. 3. In addition, this flow rate was assumed to reach the steady-state value depending on the pulse duration and frequency. According to FIG. 3, the flow rate becomes steady state at a pulse duration of about 0.05 sec and a pulse frequency of about 1 pulse per two seconds. These conditions were finally determined to minimize the oil consumption and provide an adequate flow rate of the lubricant composition to a target area (e.g., tool or working substrate at a worksite). Table 1 summarizes the final conditions used in the remaining trials of the example.

TABLE 1

| Nozzle Spray Conditions | | | | |
|---|---|---|---|---|
| Lubricant Flow Rate | Pulse Duration | Pulse Frequency | Air Pressure | Temperature |
| 1.5 ml/min | 0.05 sec | 0.5 Hz | 6 psi | 21° C. |

Figure 4:
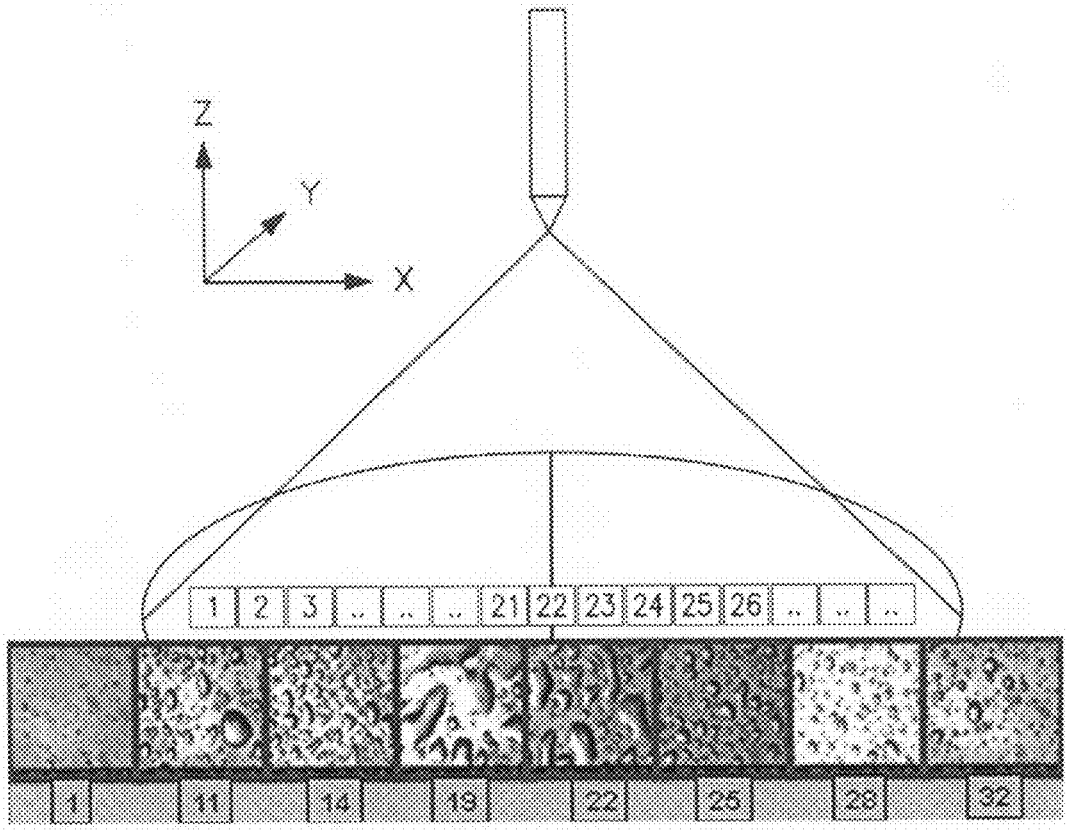
FIG. 4 illustrates a sequence of droplet images taken along the x-direction during a machining process.
Figure 5:
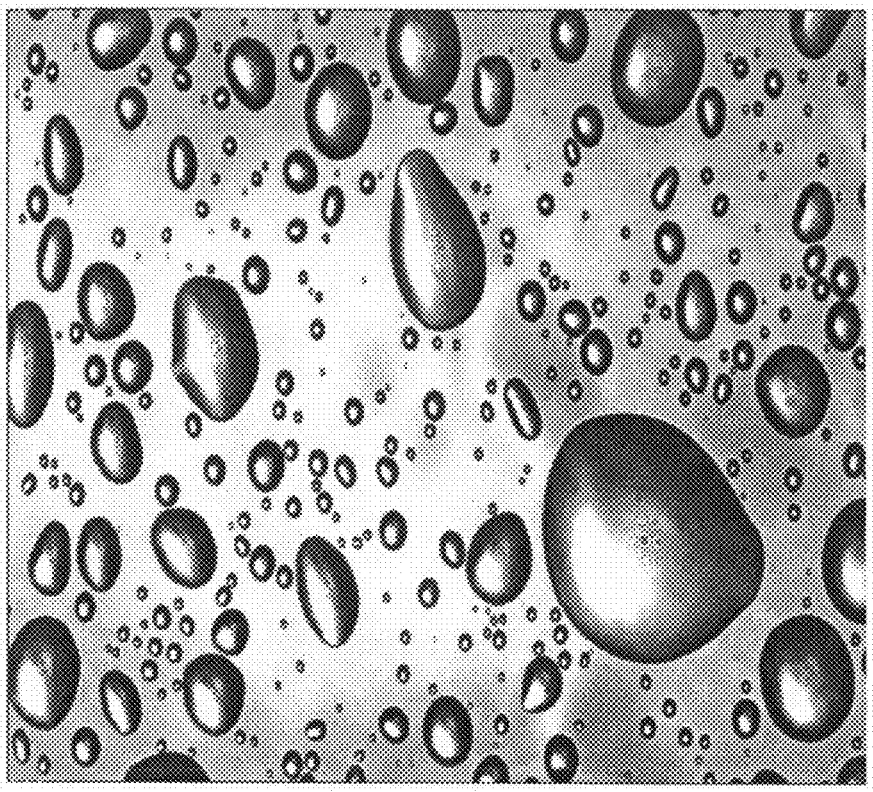
FIG. 5 illustrates a representative droplet image both before (A) and after (B) a application of the Canny detection algorithm.
Figure 5:
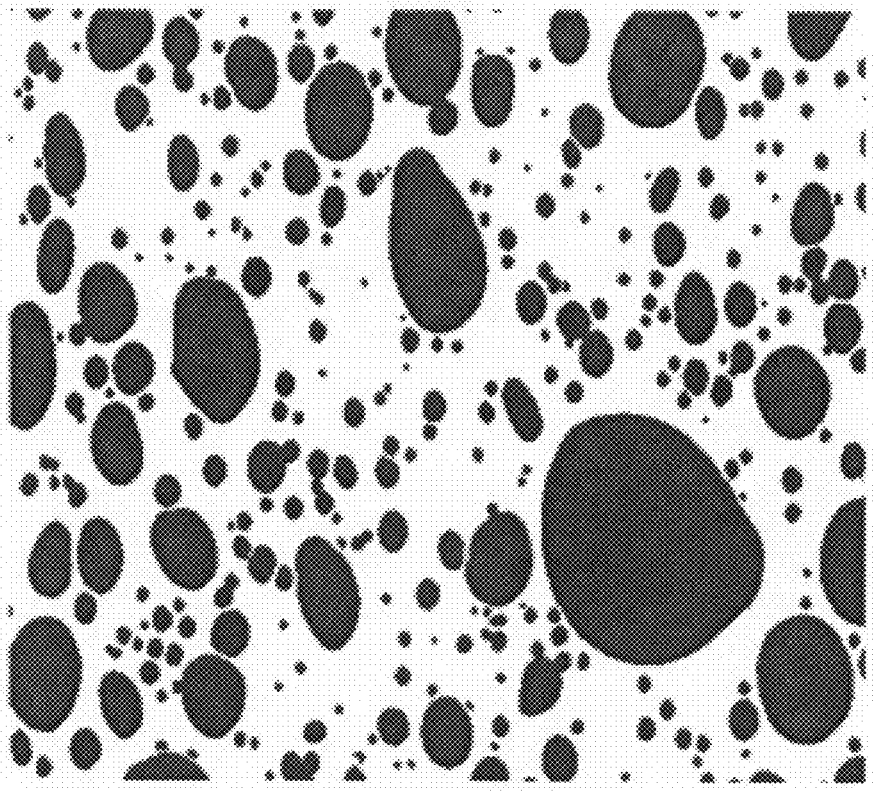
Figure 6:
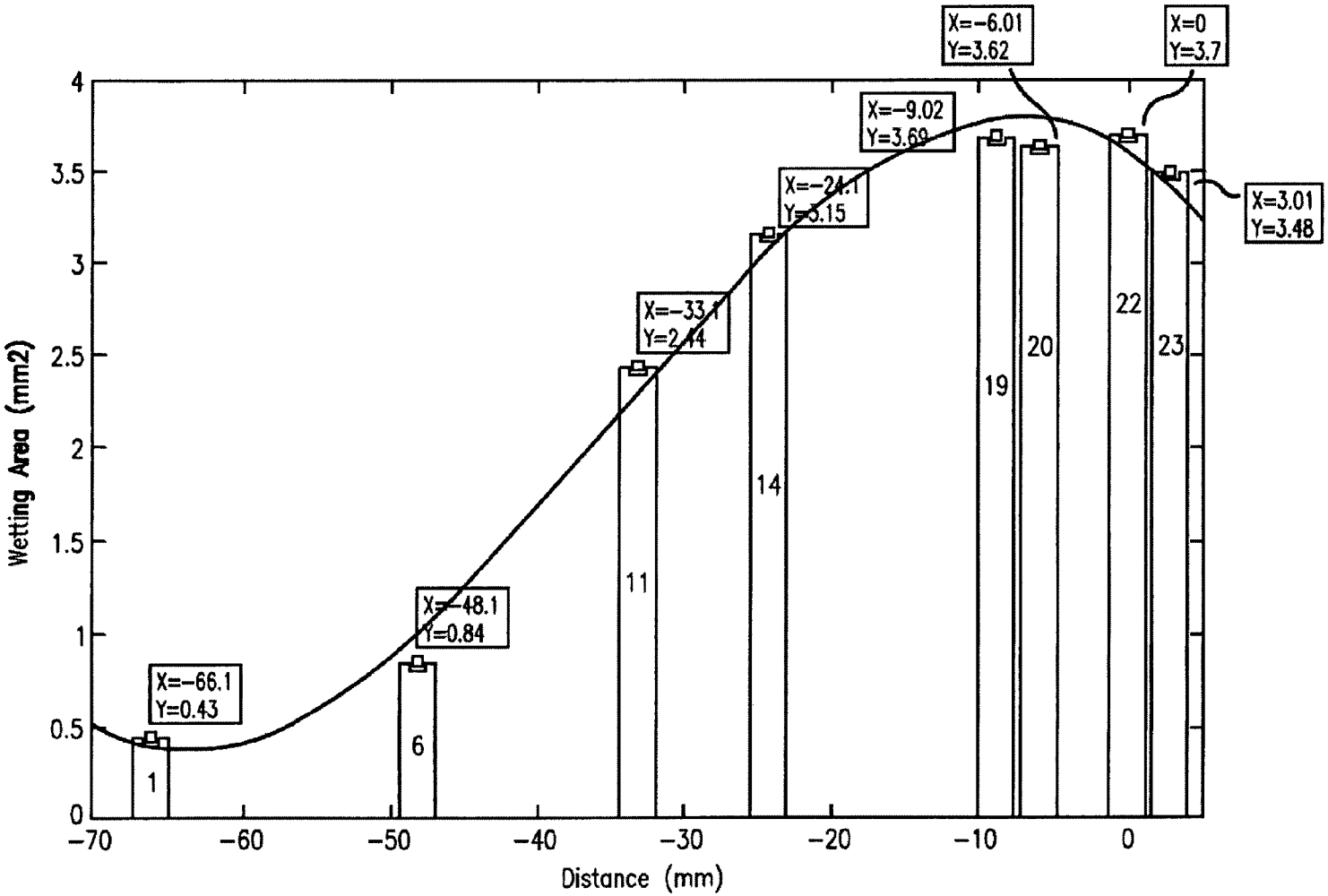
FIG. 6 is a graph illustrating the wetting area as a function of distance from the center of the spray of a lubricant composition applied as a spray mist.

FIG. 4 shows a left-to-right sequence of 2D frames captured across a diameter of the silicon wafer and containing a freshly sprayed droplet distribution. These images were captured with the 5× objective which possesses a 3006.8 μm×2000.6 μm field of view (FOV). Frames have been labeled as No. 1 through No. 32 starting from left edge. The sprayed area covered by droplets is examined to identify the size of spray diameter and droplet distribution as a function of the distance from the nozzle. This information was used to ensure that the spray angle is sufficient to cover the cutting area (or other worksite area in general). MATLAB-based image processing algorithms were used to calculate the area covered by the droplets, i.e., the wetting area. The droplet boundaries were detected by the Canny detection algorithm which looks for local maxima in the intensity gradient of the pixels. Once the edges are detected, they define the enclosed areas which are ultimately filled artificially with a black color. Each enclosed area is considered as a droplet. The wetting area can be determined by summing up all of the enclosed areas. As seen in FIG. 5, the droplet distribution image from CLSM is converted to bitmap image which captures the droplet boundaries in the original image. An enclosed area smaller than 2 pixels is eliminated because it is considered as a noise. The black area in the image helps to calculate the surface area covered by the droplets (wetting area) on the silicon wafer. FIG. 6 represents the wetting area as a function of distance from the center of spray. It is observed that the cutting zone should be located in range oft 20 mm when using a 20 cm nozzle distance in order to be in the maximum wetting region.

From the observations, the total included spray angle from the nozzle is around 32°. Within the spray angle of about 10° to 12°, multiple droplets have been agglomerated, meaning that a cutting tool is suitably sprayed within the angle of about 10° to 12° during machining. Therefore, for the 25 mm-diameter ball nose insert shown in FIG. 7, the distance between the nozzle and the tool insert suitably is around 55 mm to 60 mm to achieve adequate wetting of the cutting surface just before a cutting tool engages into a work piece.

Wetting Angle: A wetting angle measurement provides information on the bonding energy of the solid substrate and surface tension of the liquid droplet. The wetting angle θ is defined by measuring the tangent line at the interface between the droplet and the solid substrate as shown in FIG. 8 (and labeled in FIG. 8(*a*)). Smaller wetting angles should provide a better adhesion for the droplet on the substrate. To evaluate the wetting angle, a motorized syringe assembly (manufactured by AST Product, Inc.) dispenses a 0.5 μl droplet onto the substrate to be tested (i.e., TiAlN or TiSiN in this example). A CCD camera captures the droplet image produced by means of a black light LED. Representative angles measured on the left and right edge of each image are presented in FIG. 8.

It was observed that a water droplet does not adhere as well as mineral and vegetable oils. Mineral oil forms smaller angles than vegetable oil. Interestingly, the vegetable oil with the EGN material improved the adhesion as shown in FIG. 8(*d*). In general, the TiSiN substrate presents better wetting properties compared to the TiAlN substrate for all cases. Therefore, the vegetable oil/EGN material lubricant composition does not suffer any major drawback compared to the vegetable oil typically being used for an MQL machining process.

Ball Milling Tests: Several ball-milling tests were performed with the vegetable oil/EGN material lubricant composition using the determined MQL parameters. AISI 1045 steel workpieces (dimensions: 203.2 mm×127 mm×203.2 mm) were milled on a 3-axis vertical milling center, exposing a 203.2 mm×127 mm surface for milling. A layer of material was removed by the rotating ball-mill (shown in FIG. 7) traveling in the direction of 203.2 mm dimension in a line-by-line manner. The machining parameters are shown in Table 2. While most of these parameters were held constant for every test, the spindle cutting speed was varied: 2500, 3500, and 4500 RPM. In this case, the feed rate represents the speed at which the CNC table moves during machining.

TABLE 2

| Machining Parameters | | | |
|---|---|---|---|
| Cutting Speeds | Feed Rate | Axial Depth of Cut | Radial Depth of Cut |
| 2500 RPM<br>3500 RPM<br>4500 RPM | 2500 mm/min | 1 mm | 0.6 mm |

Tool Wear. Two different types of tool wear were observed by the micrographs from Confocal Laser Scanning Microscope (CLSM): central wear and flank wear, which were pronounced as shown in FIG. 9. Central wear occurs on the tip of the tool, which can be attributed to three-body abrasive wear due to the debris sliding between the tool and work material. Flank wear comes from the abrasive action by the hard inclusions in the work material. Central wear was claimed to occur in high speed milling with low feed rate (less than 1000 mm per second) in coated carbide end mills [Sokovic et al., 2004]. In this example, however, despite the fact that the feed rate was held constant at 2500 mm per minute, central wear was still observed at all three tested spindle speeds, especially during dry machining.

Figure 10:
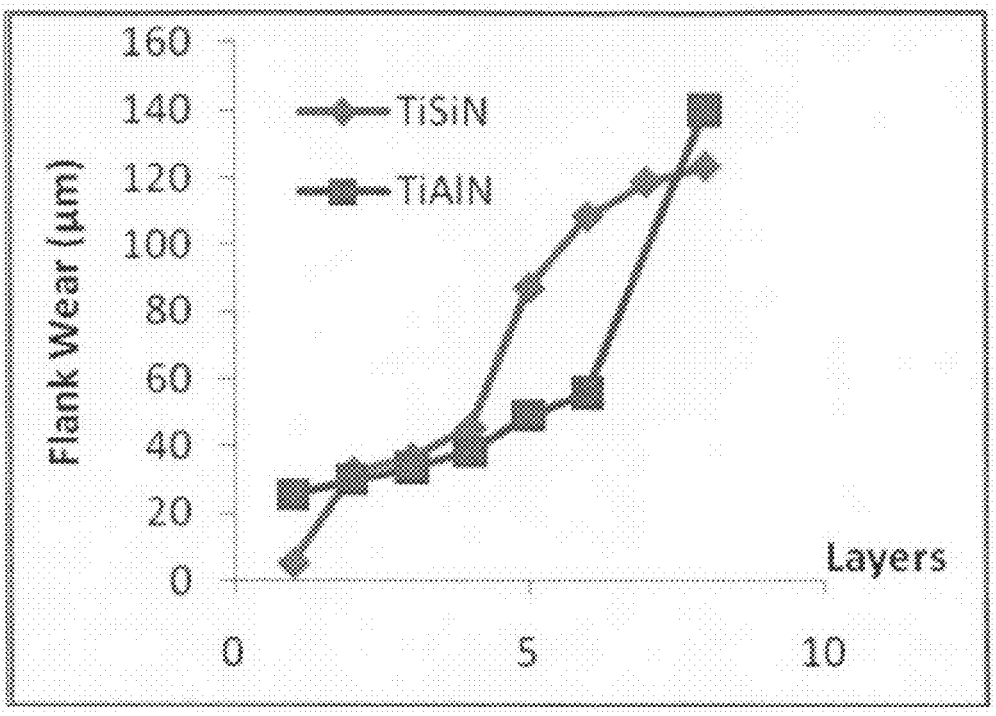
FIG. 10 illustrates the flank wear of coated inserts at 3500 rpm.
Figure 11:
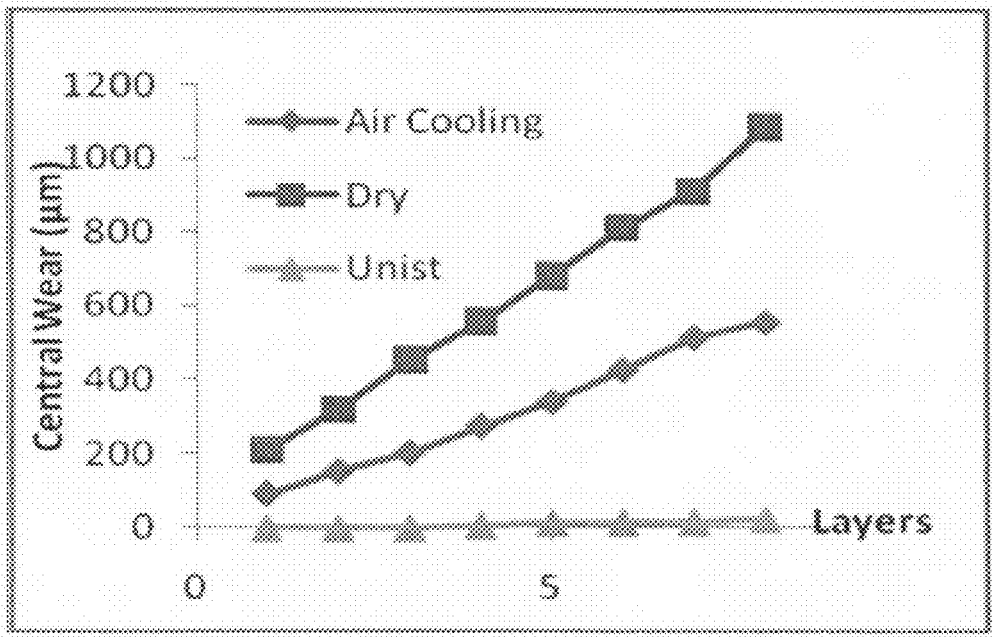
FIG. 11 illustrates the central wear on TiAlN-coated inserts at 2500 rpm.

FIG. 10 shows flank wear data for the two coatings tested at 3500 rpm using the above MQL conditions with the vegetable oil/EGN material lubricant composition: a TiSiN-coated ball nose insert and a TiAlN-coated ball nose insert (e.g., working surface 42 in FIG. 7, which can be replaced as it wears down). Despite of the difference in wetting angle for the two insert surfaces (see FIG. 8), no significant distinction between the two coatings was observed with respect to the flank wear data shown in FIG. 10. The minor difference shown in FIG. 10 between the two coatings is due the chippings. Figure Based on the results of FIG. 10 indicating that the performance difference between the two inserts was small, only TiAlN-coated inserts were used subsequently. FIG. 11 shows differences in central wear on TiAlN-coated inserts at 2500 rpm among three methods of machining: dry, air cooling, and MQL with vegetable oil alone. It is remarkable how much benefit MQL has over the other two methods. Even though the analogous experiment with flood cooling was not conducted, there is no expected improvement over the MQL method.

Figure 12:
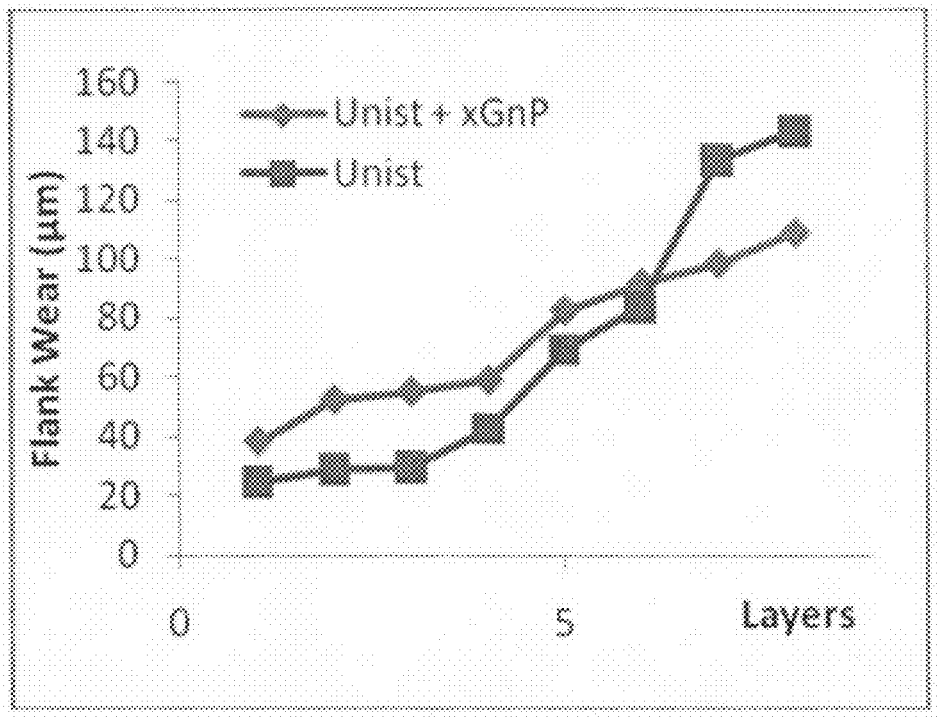
FIG. 12 illustrates the difference in flank wear of coated inserts at 3500 rpm between vegetable oil alone ("Unist") and vegetable oil/EGN material ("Unist+xGnP") used as lubricant compositions.
Figure 14:
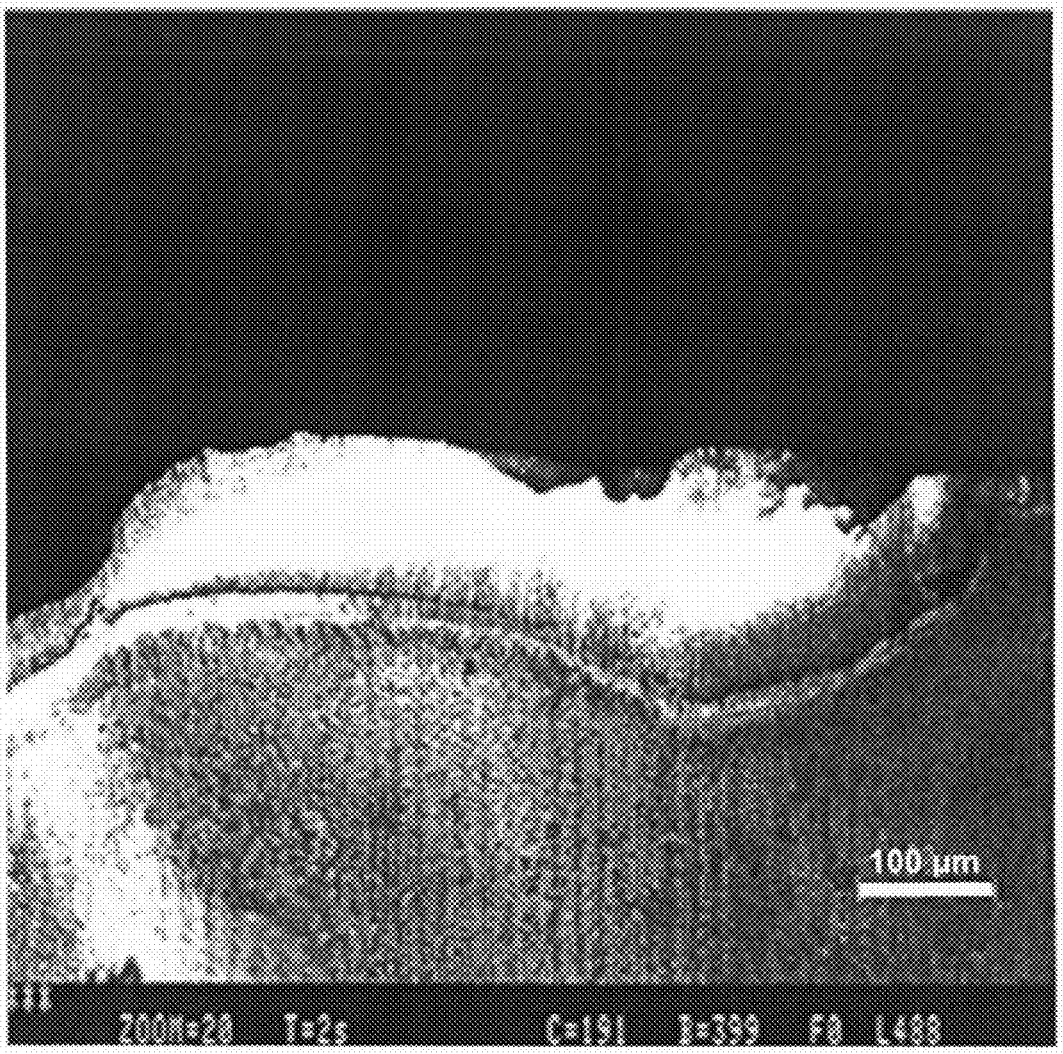
FIG. 14 are images illustrating the resulting flank wear for vegetable oil alone (A) and vegetable oil/EGN material (B) at 3500 rpm after milling 8 layers (scale bar: 100 μm).
Figure 14:
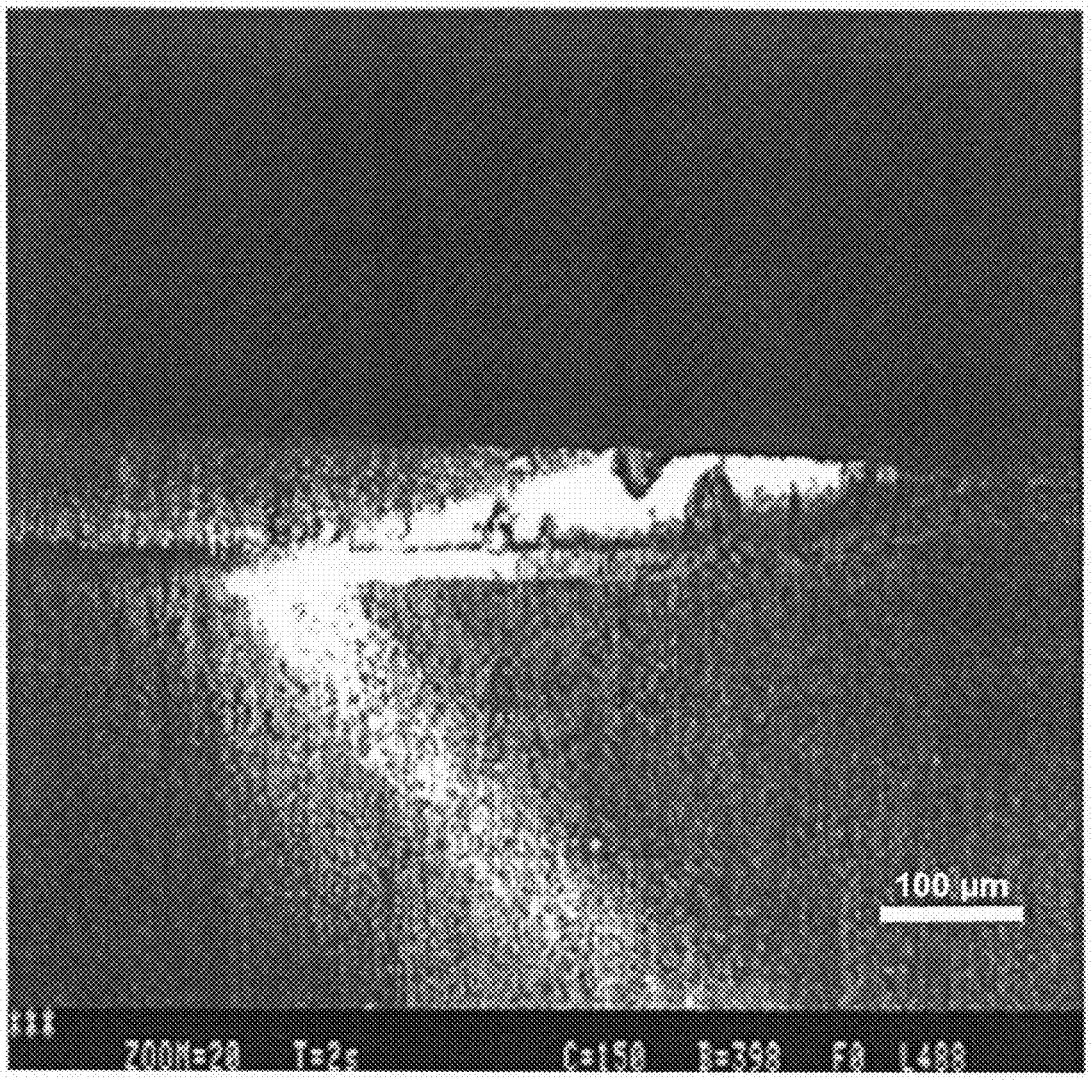

Results: TiAlN-coated inserts were used in subsequent trials using the vegetable oil/EGN material lubricant compositions, as the difference between the two coatings was found to be minimal (see FIG. 10). FIG. 12 compares the effect of an MQL process using straight vegetable oil and the vegetable oil/EGN material lubricant at a cutting speed of 3500 rpm. As shown in FIG. 12, in early stages the flank wear does not differ much between the two cases. In fact, the vegetable oil/EGN material lubricant shows slightly higher flank wear. However, at the later stages, the vegetable oil/EGN material lubricant shows a clear improvement in terms of flank wear. Without being bound to a particular theory, this is believed to be contributed by the deterrence of chipping when EGN material is present at the interface (see FIG. 14).

Figure 13:
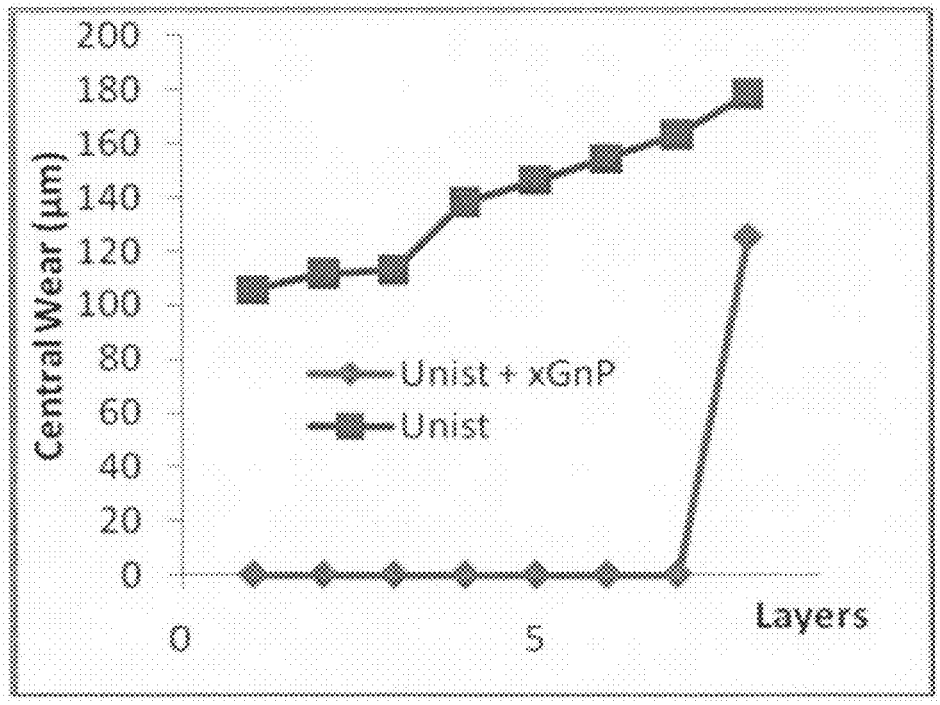
FIG. 13 illustrates the difference in central wear of coated inserts at 4500 rpm between vegetable oil alone ("Unist") and vegetable oil/EGN material ("Unist+xGnP") used as lubricant compositions.

Remarkable improvement can be observed in central wear between the two cases as shown in FIG. 13. Except for the last layer, the central wear is almost non-existent with the vegetable oil/EGN material lubricant. The abrupt increase in the central wear may be due to an unusually large chipping that may have occurred during the milling of the last layer. In terms of reducing the central wear, the vegetable oil/EGN material lubricant is substantially better than traditional vegetable oil, especially at high cutting speed.

Summary An MQL machining process has been used to determine the effective the MQL parameters for a ball-mill experiment. The ball-mill experiments indicate that small changes in MQL parameters have a large effect on performance and efficiency. The wetting angle and the droplet size distribution have been proposed to be important MQL parameters. While the wetting angle, however, did not have much observed bearing on the MQL performance in terms of tool wear, this may be the result of changes in the wetting angle due the temperature. In summary:

- CLSM followed by wavelet analysis and image processing techniques constitute a useful approach to measure the droplet surface, volume and the wetting area.
- The effective spray angle is approximately 10-12° at a flow rate of 1.5 ml/min and 6 psi air pressure.
- No significant difference in performance is observed when MQL is applied with TiAlN and TiSiN coatings.
- The vegetable oil/EGN material lubricant for MQL provides a viable solution for some machining applications.

It is intended that the foregoing description be only illustrative of the disclosed compositions and methods, and further that the present invention be limited only by the hereinafter appended claims. Because other modifications and changes varied to fit particular operating requirements and environments will be apparent to those skilled in the art, the disclosure is not considered limited to the examples chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

Throughout the specification, where the compositions, processes/methods, or apparatus are described as including components, steps, or materials, it is contemplated that the compositions, processes/methods, or apparatus can also comprise, consist essentially of, or consist of, any combination of the disclosed components or materials, unless described otherwise. Component concentrations expressed as a percent are weight-percent (% w/w), unless otherwise noted. Numerical values and ranges can represent the value/range as stated or an approximate value/range (e.g., modified by the term "about"). Combinations of components are contemplated to include homogeneous and/or heterogeneous mixtures, as would be understood by a person of ordinary skill in the art in view of the foregoing disclosure.

REFERENCES

Askvik, K. M., S. Hoiland, P. Fotland, T. Barth, T. Gronn and F. H. Fadnes (2005). "Calculation of wetting angles in crude oil/water/quartz systems," *Journal of Colloid and Interface Science*, Vol. 287, pp. 657-663.

Heinemann, R., S. Hinduja, G. Barrow and G. Petuelli, (2006). "Effect of MQL on the tool life of small twist drills in deep-hole drilling," *International Journal of Machine Tools & Manufacturing*, Vol. 46, pp. 1-6, Itoigawa, F., T. H. C. Childs, T. Nakamura and W. Belluco (2006). "Effects and Mechanisms in Minimal Quantity Lubrication Machining of Aluminum Alloys," *Wear*, Vol. 29, N. 3, pp. 339-344.

Klocke, F. and G. Eisenblatter, (1997). "Dry Cutting," *CIRP Annals-Manufacturing Technology*, Vol. 46, No. 2, pp. 510-526.

Kwon, P. and Drazl, L., (2008), Nanoparticle Graphite Based Minimum Quantity Lubrication Method and Composition, Provisional Patent Lopez de Lacalle, L. N., C. Angulo, A. Lamikiz and J. A. Sanchez (2006). "Experimental and numerical investigation of the effect of spray cutting fluids in high speed milling," *Journal of Material Processing Technology*, Vol. 172, pp. 11-15.

Shen, B., A. P. Malshe, P. Kalita and A. J. Shih (2008). "Performance of Novel MoS2 Nanoparticles Based Grinding Fluids in Minimum Quantity Lubrication Grinding," Transaction of NAMRI/SME, V. 36, pp. 357-364.

Sokovic, M., J. Kopac, L. A. Dobrzanski and M. Adamiak (2004). "Wear of PVD-coated solid carbide end mills in dry high-speed cutting," *Journal of Materials Processing Technology*, Vol. 157-158, pp. 422-426

Ueda, T., A. Hosokawa and K. Yamada, "Effect of oil mist on tool temperature in cutting," *Journal of Manufacturing Science and Engineering*, Vol. 128, pp. 130-135, 2006.

Sreejith, P. S. and B. A. Ngoi (2000). "Dry machining: Machining of the future," *Journal of Materials Processing Technology*, Vol. 101, No. 1-3, pp. 287-291.

Wakabayashi, T., I. Inasaki and S. Suda (2006) "Tribological action and optimal performance: Research activities regarding MQL machining fluids," *Machining Science and Technology*, Vol. 10, pp. 59-85.

What is claimed is:

1. A method of lubricating a tool, the method comprising:

(a) providing a lubricant composition comprising (i) a machining oil, and (ii) an exfoliated graphite nanoparticle (EGN) material stably dispersed in the machining oil, wherein: (A) the EGN material is present in the lubricant composition in an amount ranging from 0.02 wt. % to 0.1 wt. % relative to the lubricant composition; (B) the EGN material has a surface area ranging from 100 $m^2/g$ to 500 $m^2/g$; and (C) the EGN material comprises EGN particles having a diameter ranging from 0.5 μm to 15 μm, a thickness ranging from 0.5 nm to 10 nm, and a diameter-to-thickness aspect ratio ranging from 100 to 5000;

(b) contacting a tool with a substrate at a worksite; and (c) applying the lubricant composition to the worksite in the form of a mist while contacting the tool with the substrate; wherein, the lubricant composition has been ultrasonically mixed.

2. The method of claim 1, comprising applying the lubricant composition to the worksite in an amount sufficient to provide minimum quantity lubrication (MQL) at the worksite.

3. The method of claim 2, comprising applying the lubricant composition to the worksite in an amount ranging from 0.05 ml/min to 5 ml/min.

4. The method of claim 1,wherein contacting the tool with the substrate comprises performing a process selected from the group consisting of cutting, grinding, drilling, rolling, forging, pressing, milling, turning, tapping, and punching.

5. The method of claim 1, wherein the substrate comprises a metal workpiece.

6. The method of claim 1,wherein the tool comprises a material selected from the group consisting of a cemented carbide, a ceramic, or a combination thereof.

7. The method of claim 1, wherein the worksite during operation is at or above a vaporization temperature of the machining oil, thereby vaporizing at least a portion of the machining oil applied to the worksite while contacting the tool with the substrate.

8. A method of lubricating a tool, the method comprising:

(a) providing a lubricant composition comprising:

(i) a machining oil comprising a vegetable oil present in an amount of at least 99 wt. % relative to the lubricant composition, and (ii) an exfoliated graphite nanoparticle (EGN) material stably dispersed in the machining oil, wherein: (A) the EGN material has been formed by microwave heating of a graphite material for a time and at a power sufficient to remove an expanding agent intercalated between layers of the graphite material and then pulverizing the microwave-heated graphite material; (B) the EGN material is present in the lubricant composition in an amount ranging from 0.02 wt. % to 0.1 wt. % relative to the lubricant composition; (C) the EGN material has a surface area ranging from 100 $m^2/g$ to 500 $m^2/g$; and (D) the EGN material comprises EGN particles having (A) a diameter ranging from 1 μm to 15 μm, (B) a thickness ranging from 0.5 nm to 10 nm, and (C) a diameter-to-thickness aspect ratio ranging from 200 to 3000;

wherein: the lubricant composition has a first wetting angle when applied to a substrate, the first wetting angle being less than a second wetting angle for a corresponding lubricant composition without the EGN material when the corresponding lubricant is applied to the substrate;

(b) contacting a tool with a metal workpiece at a worksite; and (c) applying the lubricant composition to the worksite in the form of a mist while contacting the tool with the metal workpiece; wherein, the lubricant composition has been ultrasonically mixed.

9. The method of claim 8, wherein the lubricant composition consists essentially of:

(a) the machining oil;

(b) the EGN material; and (c) optionally one or more additives selected from the group consisting of antimicrobial agents, biocides, fungicides, wetting agents, film-forming agents, antifoam agents, corrosion inhibitors, and combinations thereof.

10. The method of claim 1, wherein the EGN material has been formed by (i) microwave or radio frequency heating of a graphite material for a time and at a power sufficient to remove an expanding agent intercalated between layers of the graphite material and then (ii) pulverizing the microwave- or radio frequency-heated graphite material.

11. The method of claim 1, wherein the EGN material contains at least 90% carbon and less than 10% oxygen.

12. The method of claim 11,wherein:

(i) the machining oil is a hydrophobic oil, and (ii) the lubricant composition is substantially free of hydrophilic liquids.

13. The method of claim 12, wherein the machining oil is selected from the group consisting of ester oils, hydrocarbon oils, and combinations thereof.

14. The method of claim 12, wherein the machining oil comprises an ester oil selected from the group consisting of soybean oil, safflower oil, linseed oil, corn oil, sunflower oil, olive oil, canola oil, sesame oil, cottonseed oil, palm oil, peanut oil, coconut oil, rapeseed oil, tung oil, castor oil, almond oil, flaxseed oil, grape seed oil, olive oil, safflower oil, sunflower oil, walnut oil, and combinations thereof.

15. The method of claim 14, wherein the lubricant composition comprises the ester oil in an amount of at least 98 wt. % relative to the lubricant composition.

16. The method of claim 1, wherein the lubricant composition further comprises:

(iii) one or more additives selected from the group consisting of antimicrobial agents, biocides, fungicides, wetting agents, film-forming agents, antifoam agents, corrosion inhibitors, and combinations thereof.

17. The method of claim 1, wherein the lubricant composition applied to at least one of the tool and the substrate has a wetting angle reduction relative to a corresponding lubricant composition without the EGN material ranging from 0.1 to 0.7.

18. A method of lubricating a tool, the method comprising:

(a) providing a lubricant composition comprising (i) a machining oil, and (ii) an exfoliated graphite nanoparticle (EGN) material stably dispersed in the machining oil, wherein:

(i) the EGN material is present in the lubricant composition in an amount ranging from 0.01 wt. % to 0.1 wt. % relative to the lubricant composition; and (ii) the EGN material comprises EGN particles having (A) a diameter ranging from 0.5 μm to 15 μm (B) a thickness ranging from 0.5 nm to 10 nm, (C) a diameter-to-thickness aspect ratio ranging from 100 to 5000, and (D) a surface area ranging from 100 $m^2/g$ to 500 $m^2/g$;

(b) contacting a tool with a substrate at a worksite; and (c) applying the lubricant composition to the worksite in the form of a mist while contacting the tool with the substrate; wherein, the lubricant composition has been ultrasonically mixed.

19. The method of claim 18, wherein the lubricant composition applied to at least one of the tool and the substrate has a wetting angle reduction relative to a corresponding lubricant composition without the EGN material ranging from 0.1 to 0.7.

20. The method of claim 1, wherein the EGN material is stably dispersed in the machining oil such that there is no observable segregation of the EGN material in the machining oil after a period of 5 days.

21. The method of claim 8, wherein the EGN material is stably dispersed in the machining oil such that there is no observable segregation of the EGN material in the machining oil after a period of 5 days.

* * * * *